US012396497B2

(12) United States Patent
Yoshida et al.

(10) Patent No.: US 12,396,497 B2
(45) Date of Patent: Aug. 26, 2025

(54) CLOTHING

(71) Applicant: SHINTAIKINOUKENKYUUJO CO., LTD., Sendai (JP)

(72) Inventors: Masato Yoshida, Sendai (JP); Takashi Sasaki, Sendai (JP)

(73) Assignee: RELIVE CO., LTD., Miyagi (JP)

( * ) Notice: Subject to any disclaimer, the term of this patent is extended or adjusted under 35 U.S.C. 154(b) by 0 days.

(21) Appl. No.: 18/182,886

(22) Filed: Mar. 13, 2023

(65) Prior Publication Data

US 2023/0248084 A1 Aug. 10, 2023

Related U.S. Application Data

(60) Division of application No. 16/910,659, filed on Jun. 24, 2020, now Pat. No. 11,659,874, which is a (Continued)

(30) Foreign Application Priority Data

Dec. 25, 2017 (JP) ..... 2017-248507

(51) Int. Cl.
*A41D 13/00* (2006.01)
*A41D 13/05* (2006.01)
(Continued)

(52) U.S. Cl.
CPC ..... *A41D 13/0015* (2013.01); *A41D 13/0518* (2013.01); *A41D 13/1245* (2013.01);
(Continued)

(58) Field of Classification Search
USPC ..... 2/69, 113
See application file for complete search history.

(56) References Cited

U.S. PATENT DOCUMENTS 2,986,740 A 6/1961 Schudson
4,475,552 A 10/1984 Yoshihara
(Continued)

FOREIGN PATENT DOCUMENTS

CN 202999361 U 6/2013
JP 3032453 U 12/1996
(Continued)

OTHER PUBLICATIONS

Written Opinion for PCT/ISA/237 for International Application No. PCT/JP2018/014017 dated Apr. 15, 2018.
(Continued)

*Primary Examiner* — Jocelyn Bravo
(74) *Attorney, Agent, or Firm* — Harness, Dickey & Pierce, P.L.C.

(57) ABSTRACT

Issue
To make available clothing that supports the wearer's muscles to enable capacity for and flexibility in movement to be improved in situations such as during sports, during heavy lifting, or being under nursing care.
Resolution Means
Clothing 100 involving the present invention is furnished with an upper-body piece 10 for covering at least a portion of the upper half of the body, and an upper-body support unit 20 formed on the upper-body piece 10. The upper-body support unit 20 includes an upper-body first support section 21 situated in sites following at least a portion of the psoas major muscles (901), an upper-body second support section 22 situated in sites following the supraspinatus muscles (903), and an upper-body third support section 23 situated in sites following the teres major muscles (904).

10 Claims, 23 Drawing Sheets

Related U.S. Application Data continuation of application No. PCT/JP2018/014017, filed on Mar. 30, 2018.

(51) Int. Cl.
*A41D 13/12* (2006.01)
*A41D 31/04* (2019.01)

(52) U.S. Cl.
CPC ..... *A41D 31/04* (2019.02); *A41D 2300/22* (2013.01); *A41D 2400/38* (2013.01)

(56) References Cited

U.S. PATENT DOCUMENTS

| | | | |
|---|---|---|---|
| 4,698,847 | A | 10/1987 | Yoshihara |
| 4,731,882 | A | 3/1988 | Ekman |
| 4,862,523 | A | 9/1989 | Lipov |
| 4,946,453 | A | 8/1990 | Monson |
| 5,046,194 | A | 9/1991 | Alaniz et al. |
| 5,109,546 | A | 5/1992 | Dicker |
| 5,201,074 | A | 4/1993 | Dicker |
| 5,359,735 | A | 11/1994 | Stockwell |
| 5,367,708 | A | 11/1994 | Fujimoto |
| 5,699,559 | A | 12/1997 | Sano |
| 5,819,322 | A | 10/1998 | Dicker et al. |
| 5,829,058 | A | 11/1998 | Dicker et al. |
| 5,857,947 | A | 1/1999 | Dicker et al. |
| 5,867,827 | A | 2/1999 | Wilkinson |
| 5,875,491 | A | 3/1999 | Wilkinson |
| 5,896,578 | A | 4/1999 | Hunter et al. |
| 5,937,442 | A | 8/1999 | Yamaguchi et al. |
| 6,231,488 | B1 | 5/2001 | Dicker et al. |
| 6,430,752 | B1 | 8/2002 | Bay |
| 6,430,753 | B2 | 8/2002 | Duran |
| 6,446,264 | B2 | 9/2002 | Fairhurst et al. |
| 6,684,410 | B2 | 2/2004 | Robinett et al. |
| 6,728,973 | B1 | 5/2004 | Webley et al. |
| 6,892,396 | B2 | 5/2005 | Uno et al. |
| 7,089,597 | B2 | 8/2006 | Horii et al. |
| 7,516,498 | B2 | 4/2009 | Torry |
| 7,559,093 | B2 | 7/2009 | Sudo et al. |
| 7,636,950 | B2 | 12/2009 | Melhart et al. |
| 7,670,205 | B2 | 3/2010 | Oyama et al. |
| 7,677,953 | B2 | 3/2010 | Oyama et al. |
| 7,814,576 | B2 | 10/2010 | Nakazawa |
| 7,908,670 | B2 | 3/2011 | Semba et al. |
| 8,196,220 | B2 | 6/2012 | Rance et al. |
| 8,286,262 | B2 | 10/2012 | Rance et al. |
| 8,533,864 | B1 | 9/2013 | Kostrzewski |
| 8,707,463 | B2 | 4/2014 | Orloff |
| 9,144,252 | B1 | 9/2015 | Kostrzewski |
| 9,226,534 | B2 | 1/2016 | Puni |
| 9,326,554 | B2 | 5/2016 | Lou et al. |
| 9,642,401 | B2 | 5/2017 | Yamada et al. |
| D796,792 | S | 9/2017 | Fisher et al. |
| D805,734 | S | 12/2017 | Fisher et al. |
| D807,519 | S | 1/2018 | Shin |
| 9,854,854 | B2 | 1/2018 | Canales et al. |
| 9,895,569 | B2 | 2/2018 | Yao |
| D816,300 | S | 5/2018 | Brown |
| D824,643 | S | 8/2018 | Glazer |
| D826,517 | S | 8/2018 | Mareco |
| 10,039,330 | B2 | 8/2018 | Tanaka et al. |
| 10,051,897 | B2 | 8/2018 | Freddi et al. |
| 10,264,828 | B2 | 4/2019 | Brown |
| 10,426,649 | B2 | 10/2019 | Lyu |
| 10,555,562 | B2 | 2/2020 | Poirier |
| D876,753 | S | 3/2020 | Francis |
| 10,631,583 | B2 | 4/2020 | Musciacchio |
| 10,721,975 | B2 | 7/2020 | Liu |
| D899,728 | S | 10/2020 | Poysti et al. |
| D899,729 | S | 10/2020 | Poysti et al. |
| 10,813,390 | B2 | 10/2020 | Joseph |
| 10,842,204 | B2 | 11/2020 | Stricker |
| D930,332 | S | 9/2021 | Verner et al. |
| D930,953 | S | 9/2021 | Moreau et al. |
| 2004/0133959 | A1 | 7/2004 | Horii et al. |
| 2004/0255358 | A1 | 12/2004 | Ota et al. |
| 2007/0214541 | A1 | 9/2007 | Kawasaki et al. |
| 2007/0294801 | A1 | 12/2007 | Furgerson et al. |
| 2008/0083055 | A1* | 4/2008 | Onda ..... A61F 13/08 2/455 |
| 2009/0062704 | A1 | 3/2009 | Brown et al. |
| 2009/0265828 | A1* | 10/2009 | Semba ..... A41D 31/185 2/243.1 |
| 2010/0077527 | A1 | 4/2010 | Lee et al. |
| 2010/0229284 | A1 | 9/2010 | Wilson, II |
| 2011/0209267 | A1 | 9/2011 | Rush et al. |
| 2011/0302686 | A1 | 12/2011 | Chapuis |
| 2012/0174282 | A1 | 7/2012 | Newton et al. |
| 2013/0160189 | A1* | 6/2013 | Yang ..... A63B 21/4011 2/227 |
| 2013/0212767 | A1 | 8/2013 | Nordstom et al. |
| 2013/0326785 | A1 | 12/2013 | Cornacchiari et al. |
| 2014/0148741 | A1 | 5/2014 | Moran |
| 2014/0317826 | A1 | 10/2014 | Decker |
| 2016/0183606 | A1* | 6/2016 | Shriver ..... A63B 21/0552 2/69 |
| 2016/0366963 | A1 | 12/2016 | Koshkaroff et al. |

FOREIGN PATENT DOCUMENTS

| | | | |
|---|---|---|---|
| JP | 2002-212814 | A | 7/2002 |
| JP | 2007-16382 | A | 1/2007 |
| JP | 4061336 | B1 | 3/2008 |
| JP | 2011021291 | A | 2/2011 |
| JP | 2011-122264 | A | 6/2011 |
| JP | 2012-101107 | A | 5/2012 |
| KR | 101071481 | B1 | 10/2011 |
| WO | WO-2008/139958 | A1 | 11/2008 |
| WO | WO-2010/100721 | A1 | 9/2010 |

OTHER PUBLICATIONS

International Search Report PCT/ISA/210 for International Application No. PCT/JP2018/014017 Dated Apr. 26, 2018.
Japanese Notice of Allowance and English translation thereof dated Jul. 31, 2018.
Extended European Search Report dated Sep. 15, 2021.
U.S. Notice of Allowance dated Feb. 8, 2022 issued in corresponding International Design U.S. Appl. No. 35/509,039.
Written opinion for PCT/ISA/237 for International Application No. PCT/JP2018/014017 dated May 15, 2018.

* cited by examiner

FIG. 26

| | Single-Leg Stance | | | Forward Bend | | | Arm Wrestling | | | Aiki-Age | | | Rise | | | Arm-Twist | | | Nursing Care | | | Activeness Level | | | Stableness Level | | | Pleasantness Level | | | Alertness Level | | |
|---|---|---|---|---|---|---|---|---|---|---|---|---|---|---|---|---|---|---|---|---|---|---|---|---|---|---|---|---|---|---|---|---|---|
| | Before | After | Change | Before | After | Change | Before | After | Change | Before | After | Change | Before | After | Change | Before | After | Change | Before | After | Change | Before | After | Change | Before | After | Change | Before | After | Change | Before | After | Change |
| No. 1 | 60 | 60 | - | 20 | 27 | 7 | -10 | 7 | 13 | 7 | 7 | 0 | 1.5 | 1.5 | 0 | × | △ | | × | 13 | 23 | 6 | 6 | 0 | 5 | 6 | 1 | 11 | 12 | 1 | 1 | 0 | -1 |
| No. 2 | 60 | 60 | - | -15 | -5 | 10 | 3 | 0.5 | 2.5 | 2 | 1 | 1 | 1.5 | 1 | 0.5 | ○ | ○ | | 8 | 3 | 5 | 4 | 6 | 2 | 6 | 6 | 0 | 10 | 12 | 2 | -2 | 0 | 2 |
| No. 3 | 60 | 60 | - | -16 | -16 | 0 | 6 | 3 | 3 | 20 | 5 | 15 | 2 | 1 | 1 | × | × | | 8 | 5 | 3 | 4 | 7 | 3 | 5 | 2 | 3 | 9 | 9 | 0 | -1 | 5 | 6 |
| No. 4 | 57 | 60 | 3 | -3 | -1 | 2 | 8 | 3 | 5 | × | △ | | 5 | 2 | 3 | × | × | | 15 | 5 | 10 | 0 | 3 | 3 | 2 | 1 | -1 | 2 | 4 | 2 | -2 | 2 | 4 |
| No. 5 | 35 | 60 | +25 | 1 | 3 | 2 | 10 | 4 | 6 | 6 | 4 | 2 | 1.5 | 1 | 0.5 | × | △ | | × | △ | | 1 | 8 | 7 | 4 | 8 | 4 | 5 | 16 | 11 | -3 | 0 | 3 |
| No. 6 | 60 | 60 | - | -14 | -7 | 7 | 7 | 3 | 4 | 4 | 2 | 2 | 4 | 2 | 2 | × | △ | | -8 | 1 | 9 | 0 | 10 | 10 | 5 | 5 | 0 | 5 | 15 | 10 | -5 | 5 | 10 |
| No. 7 | 60 | 60 | - | -12.5 | -10.5 | 2 | 3 | 1 | 2 | △ | ○ | | 1 | 0.5 | 0.5 | × | ○ | ○ | 1 | 1 | 0 | 7 | 10 | 3 | 8 | 10 | 2 | 15 | 20 | 5 | -1 | 0 | 1 |
| No. 8 | 60 | 60 | - | | -11.5 | | 23 | 9 | 14 | × | ○ | ◎ | 12 | 2 | 10 | × | ○ | ○ | 15 | 3.5 | 12 | -4 | 2 | 6 | 0 | 6 | 6 | -4 | 8 | 12 | -4 | -4 | 0 |
| No. 9 | 60 | 60 | - | -22 | -9 | 13 | -10 | 3 | 13 | △ | ○ | ○ | × | 0.5 | | × | △ | | -8 | 2 | 10 | 1 | 4 | 3 | 1 | 10 | 9 | 2 | 14 | 12 | 0 | -6 | -6 |
| No. 10 | 60 | 60 | - | -10 | -10 | 0 | 10 | 9 | 1 | 10 | 2 | 8 | 2 | 1 | 1 | × | × | | 3 | 1 | 2 | 5 | 9 | 4 | 3 | 8 | 5 | 8 | 17 | 9 | 2 | 1 | -1 |
| No. 11 | 60 | 22 | -38 | 0 | 1 | 1 | -8 | 1 | 9 | × | 2 | | × | 1 | | × | ○ | ○ | 7 | 3 | 4 | 0 | 5 | 5 | 0 | 0 | 0 | 0 | 5 | 5 | 0 | 5 | 5 |
| No. 12 | 60 | 60 | - | -15 | -4 | 11 | 6 | 2 | 4 | 2 | 0.5 | 1.5 | 1 | 0.5 | 0.5 | × | ○ | ○ | 5 | 0.5 | 4.5 | 1 | 8 | 7 | 0 | 5 | 5 | 1 | 13 | 12 | 1 | 3 | 2 |
| No. 13 | 12 | 60 | +48 | -28 | -11 | 17 | 10 | 2 | 8 | 5 | 1 | 4 | 1 | 0.9 | 0.1 | × | △ | | 5 | 2 | 3 | 8 | 9 | 1 | 1 | 10 | 9 | 9 | 19 | 10 | 7 | -1 | -8 |
| No. 14 | 60 | 60 | - | 10 | 20 | 10 | 8 | 0.2 | 7.8 | △ | 1 | | 3 | 0.5 | 2.5 | × | ○ | ○ | 4 | 0.2 | 3.8 | 2 | 10 | 8 | 6 | 9 | 3 | 8 | 19 | 11 | -4 | 1 | 5 |
| No. 15 | 60 | 60 | - | 17 | 20 | 3 | 5 | 4 | 1 | △ | 4 | | 1 | 1 | 0 | ○ | ○ | | 3 | 1.5 | 1.5 | 4 | 6 | 2 | 5 | 6 | 1 | 9 | 12 | 3 | -1 | 0 | 1 |
| No. 16 | 60 | 60 | - | 0 | 1 | 1 | 6 | 2 | 4 | △ | ○ | ○ | × | ○ | | × | ○ | ○ | × | △ | | 2 | 3 | 1 | 2 | 3 | 1 | 4 | 6 | 2 | 0 | 0 | 0 |
| No. 17 | 60 | 60 | - | -16 | -14 | 2 | -7 | 2 | 9 | 8 | 4 | 4 | 1.5 | 1 | 0.5 | × | ○ | ○ | 14 | 5 | 9 | 4 | 8 | 4 | 2 | 8 | 6 | 6 | 16 | 10 | 2 | 0 | -2 |
| Avg. | 55.5 | 57.7 | | -6.5 | -1.6 | 5.5 | 4.1 | 3.3 | 6.3 | 7.1 | 2.8 | 4.2 | 2.7 | 1.1 | 1.6 | | | | 5.1 | 3.1 | 6.6 | 2.6 | 6.7 | 4.1 | 3.2 | 6 | 3.2 | 5.9 | 13 | 6.9 | -0.6 | 0.6 | 1.2 |

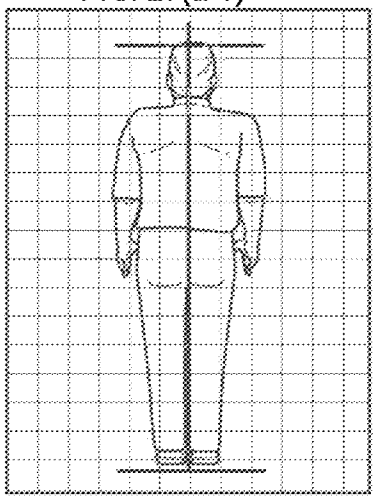
FIG. 27(a-1)
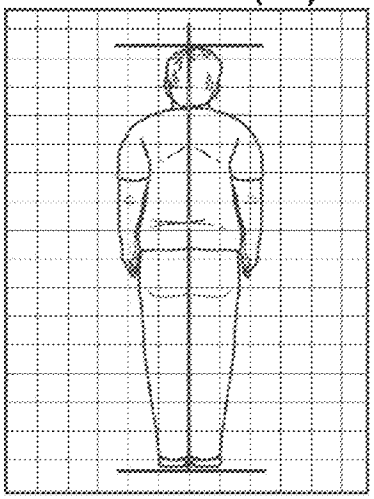
FIG. 27(a-2)
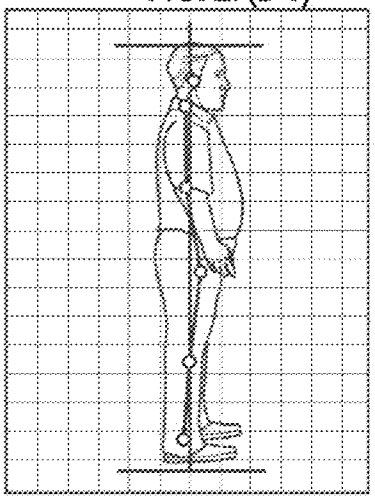
FIG. 27(b-1)
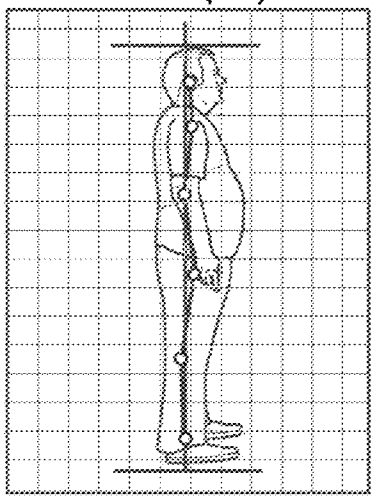
FIG. 27(b-2)
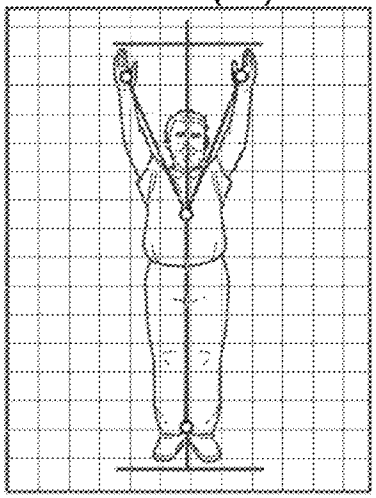
FIG. 27(c-1)
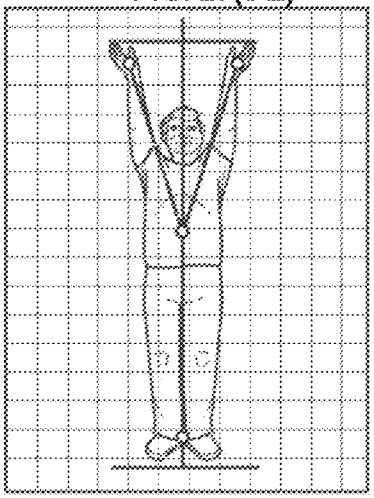
FIG. 27(c-2)
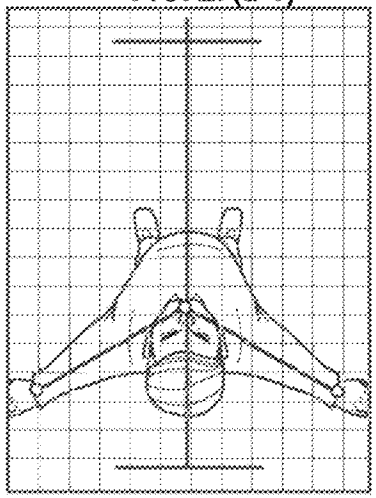
FIG. 27(d-1)
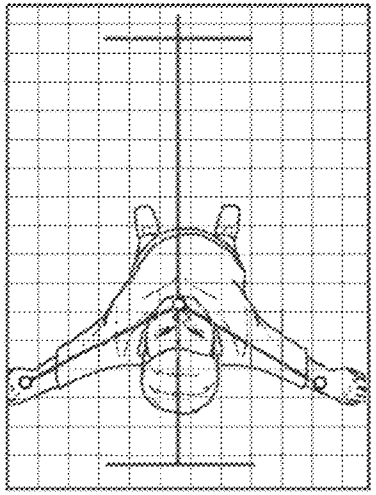
FIG. 27(d-2)

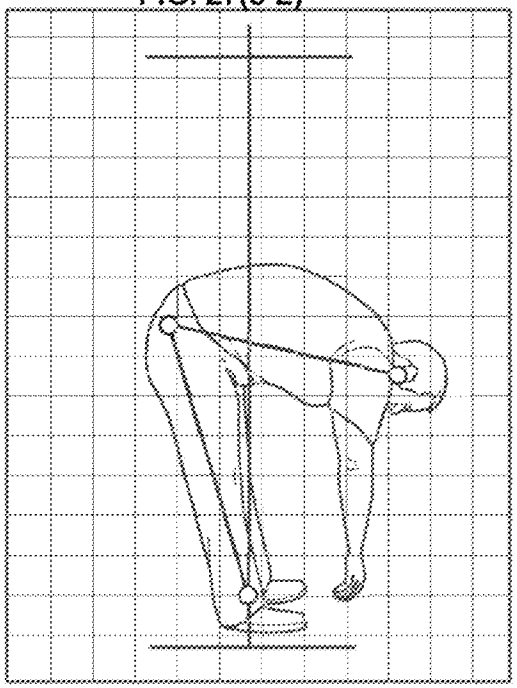
FIG. 27(e-2)
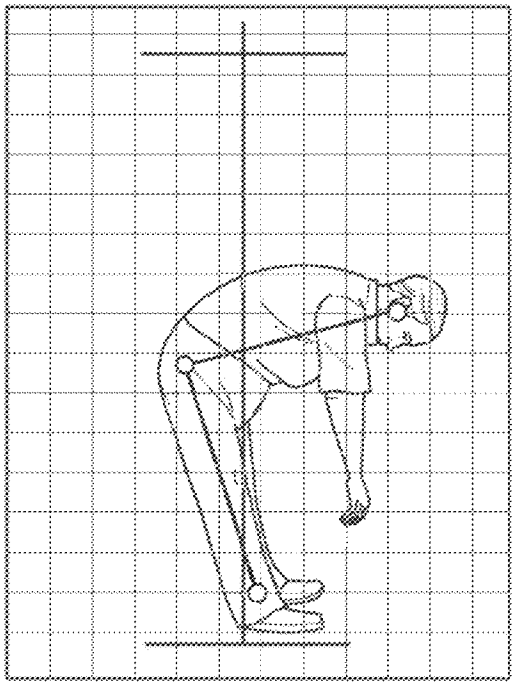
FIG. 27(e-1)

FIG. 28

| **Question:** Which of the following words fits your mental state (feeling) now? Please circle the closest text. | | Does not apply at all | Slightly applies | Somewhat applies | To a certain extent applies | Considerably applies | Very much applies |
|---|---|---|---|---|---|---|---|
| **a.** | Calm | 0 | 1 | 2 | 3 | 4 | 5 |
| **b.** | Irritated | 0 | 1 | 2 | 3 | 4 | 5 |
| **c.** | Weary | 0 | 1 | 2 | 3 | 4 | 5 |
| **d.** | Energetic | 0 | 1 | 2 | 3 | 4 | 5 |
| **e.** | Relaxed | 0 | 1 | 2 | 3 | 4 | 5 |
| **f.** | Tense | 0 | 1 | 2 | 3 | 4 | 5 |
| **g.** | Slack | 0 | 1 | 2 | 3 | 4 | 5 |
| **h.** | Animated | 0 | 1 | 2 | 3 | 4 | 5 |

Grading & Analysis Method

Into the following formulas, enter the numeric figure (score from 0 to 5) answered to question items a. through h. to calculate a score for each: Activeness Level (V), Stableness Level(S), Pleasantness Level (P), Alertness Level (A).

Activeness Level (V) = d. ( ) + h. ( ) - c. ( ) - g. ( ) = V [ ]

Stableness Level (S) = a. ( ) + e. ( ) - b. ( ) - f. ( ) = S [ ]

Pleasantness Level (P) = V [ ] + S [ ] = [ ]

Alertness Level (A) = V [ ] - S [ ] = [ ]

FIG. 29(a)

| Forehand Comparing | Ball Spin | Swing Speed | Ball Speed | Forehand Wearing | Ball Spin | Change %-age | Swing Speed | Change %-age | Ball Speed | Change %-age |
|---|---|---|---|---|---|---|---|---|---|---|
| No. 21 | 3.4 | 111.6 | 115.3 | No. 21 | 3.7 | 109 | 107.6 | 96.4 | 108.6 | 94 |
| No. 22 | 3.9 | 108.7 | 116.5 | No. 22 | 4.15 | 106 | 113 | 104 | 120 | 103 |
| No. 23 | 4.35 | 97.2 | 102 | No. 23 | 4.1 | 94.2 | 103.8 | 107 | 110 | 108 |
| No. 24 | 3.45 | 110.4 | 102.4 | No. 24 | 3.5 | 101 | 107.9 | 97.7 | 103 | 101 |
| No. 25 | 4.55 | 108.6 | 103 | No. 25 | 4.52 | 99.3 | 110.2 | 101 | 110.7 | 107 |
| No. 26 | 4.2 | 113 | 110.7 | No. 26 | 4.1 | 98 | 113.3 | 100 | 117.3 | 106 |
| No. 27 | 5.4 | 139.8 | 141.3 | No. 27 | 4.75 | 88 | 139.7 | 99.9 | 140.75 | 99.6 |
| No. 28 | 3.85 | 95.35 | 97.5 | No. 28 | 3.4 | 88 | 111 | 116 | 120.7 | 124 |
| No. 29 | 4.05 | 93.25 | 91.45 | No. 29 | 4.1 | 101 | 97.5 | 105 | 96.45 | 105 |
| No. 30 | 3.95 | 91.8 | 87.9 | No. 30 | 3.25 | 82 | 93.8 | 102 | 94 | 107 |
| No. 31 | 2.55 | 79.9 | 85.9 | No. 31 | 2.7 | 106 | 80.5 | 101 | 87.6 | 102 |
| No. 32 | 3.1 | 102.9 | 98.2 | No. 32 | 3.75 | 121 | 116.6 | 113 | 123.6 | 126 |
| No. 33 | 5.1 | 134.6 | 111.3 | No. 33 | 5.25 | 103 | 136.5 | 101 | 118.8 | 107 |
| No. 34 | 4.2 | 86.9 | 84.5 | No. 34 | 4.1 | 98 | 89.6 | 103 | 86.4 | 102 |
| No. 35 | 3.3 | 110 | 113.9 | No. 35 | 4.1 | 124 | 113 | 103 | 112.3 | 99 |
| Avg. | 3.96 | 105.6 | 104.1 | | 3.96 | 100 | 108.9 | 103.3 | 110 | 106 |

FIG. 29(b)

| Backhand Comparing | Ball Spin | Swing Speed | Ball Speed | Backhand Wearing | Ball Spin | Change %-age | Swing Speed | Change %-age | Ball Speed | Change %-age |
|---|---|---|---|---|---|---|---|---|---|---|
| No. 21 | 1.9 | 91.45 | 100.4 | No. 21 | 2.1 | 110 | 90.3 | 99 | 99.4 | 99 |
| No. 22 | 2.35 | 93.9 | 112.6 | No. 22 | 2.5 | 106 | 97.95 | 104 | 115.6 | 103 |
| No. 23 | 3 | 79 | 89 | No. 23 | 3.1 | 103 | 80 | 101 | 89 | 100 |
| No. 24 | 2.8 | 95 | 96 | No. 24 | 3.1 | 110 | 96 | 101 | 96.5 | 101 |
| No. 25 | 1.2 | 88.9 | 100.6 | No. 25 | 2.5 | 208 | 96.3 | 108 | 106.5 | 106 |
| No. 26 | 3.2 | 92.1 | 97.8 | No. 26 | 3.15 | 98 | 96.15 | 104 | 107.9 | 110 |
| No. 27 | 4.15 | 97.45 | 95.75 | No. 27 | 3.7 | 89 | 99.2 | 102 | 99.3 | 104 |
| No. 28 | 2.5 | 81.1 | 93.9 | No. 28 | 2.5 | 100 | 90.5 | 112 | 106.5 | 113 |
| No. 29 | 3.4 | 88.5 | 88.75 | No. 29 | 3.15 | 93 | 91.4 | 103 | 94.6 | 107 |
| No. 30 | −6.85 | 70.5 | 71.8 | No. 30 | −7.75 | 113 | 68.2 | 97 | 68.2 | 95 |
| No. 31 | 1.4 | 60.9 | 69.9 | No. 31 | 1.55 | 110 | 66.8 | 110 | 78.1 | 112 |
| Avg. | 1.73 | 85.3 | 92.4 | | 1.78 | 103 | 88.4 | 103.7 | 96.5 | 104.5 |

FIG. 29(c)

| Serve Comparing | Ball Spin | Swing Speed | Ball Speed | Serve Wearing | Ball Spin | Change %-age | Swing Speed | Change %-age | Ball Speed | Change %-age |
|---|---|---|---|---|---|---|---|---|---|---|
| No. 21 | 5.5 | 127.4 | 121.5 | No. 21 | 5.2 | 95 | 128.1 | 101 | 117.9 | 97 |
| No. 22 | 0 | 114.9 | 126.7 | No. 22 | 1 | ~ | 112.9 | 98 | 127.7 | 101 |
| No. 23 | 5.2 | 125.7 | 121.7 | No. 23 | 4.9 | 94 | 132.7 | 106 | 129.7 | 107 |
| No. 24 | 8.8 | 129.5 | 126.4 | No. 24 | 8 | 91 | 131.4 | 101 | 128.1 | 101 |
| No. 25 | 5.2 | 159.5 | 148.4 | No. 25 | 6.1 | 117 | 155.4 | 97 | 145 | 98 |
| No. 26 | 6.8 | 140.8 | 152.7 | No. 26 | 8.3 | 122 | 147 | 104 | 146.6 | 96 |
| No. 27 | 2.7 | 140.3 | 157.1 | No. 27 | 2.7 | 100 | 141.6 | 101 | 152.9 | 97 |
| No. 28 | 3.7 | 139.9 | 163.3 | No. 28 | 3.4 | 92 | 143.7 | 103 | 166.7 | 102 |
| Avg. | 4.73 | 134.75 | 139.7 | | 4.95 | 102 | 136.6 | 101 | 139.3 | 100 |

FIG. 35

| | | 1st Shot | 2nd Shot | 3rd Shot | 4th Shot | 5th Shot | 6th Shot | 7th Shot | 8th Shot | 9th Shot | 10th Shot | Remarks |
|---|---|---|---|---|---|---|---|---|---|---|---|---|
| No. 31 | Comp. Ex. | Left 10 | Right 5 | Center | Center | Left 10 | Center | Left 5 | Left 10 | Left 10 | | Passable condition. |
| | Embod. Ex. | Center | Center | Center | Left 10 | Left 10 | Left 10 | Left 10 | Center | Center | Right 5 | Felt that swing speed went up; Feeling of power on backswing was different. |
| No. 32 | Comp. Ex. | Left 15 | Right 10 | Left 10 | Left 10 | Center | Center | Left 10 | Left 15 | Center | Left 20 | Tension going into the hit. |
| | Embod. Ex. | Right 10 | Left 5 | Right 5 | Center | Left 10 | Right 10 | Left 10 | Center | Left 10 | Left 5 | Tension going into the hit went away. |
| No. 33 | Comp. Ex. | Left 10 | Center | Left 10 | Center | Top | Left 15 | Center | Left 15 | Left 15 | | Power is in the right half. |
| | Embod. Ex. | Center | Center | Center | Left 10 | Center | | | | | | Gained balance right•left; took away slight tension. |
| No. 34 | Comp. Ex. | Right 5 | Left 5 | Left 5 | Center | Left 5 | | | | | | Passable. |
| | Embod. Ex. | Center | Right 15 | Right 10 | Center | Center | | | | | | Hit lightly. |
| No. 35 | Comp. Ex. | Left 10 | Left 10 | Right 10 | Left 10 | Left 10 | | | | | | Feel as usual. |
| | Embod. Ex. | Left 10 | Center | Right 10 | Center | Center | | | | | | Right pelvic joint was stiff, but became able to move, as though leaping. |
| No. 36 | Comp. Ex. | Shank | Right 10 | Center | Right miss | Center | | | | | | Feel as usual. |
| | Embod. Ex. | Right 10 | Right miss | Right 10 | Right 10 | Right 10 | | | | | | Have heft. |

CLOTHING

The present invention relates to clothing. It relates particularly to clothing (for example, shirts, pants, skinsuits or union suits, etc.) that enable the wearer's muscles to be supported in situations such as during sports, during heavy lifting, or being under nursing care. This application is a divisional of U.S. patent application Ser. No. 16/910,659, filed on Jun. 24, 2020, which is a continuation of PCT International Application No. PCT/JP2018/014017 which has an International filing date of Mar. 30, 2018, which claims the benefit of priority based upon Japanese Patent Application No. 2017-248507, filed on Dec. 25, 2017; the entire contents of each of which of are hereby incorporated into the present specification by reference.

TECHNICAL FIELD

Background Art

Athletic wear for improving athletic performance when sports and other athletic games are engaged in has become familiar in recent years. It is evident that needs appertaining to athletic wear are very deep-seated. To take the example of golf: users who think they would like to raise their club-head speed and extend their flight distance even without daily strength training and stretching have become an appreciably numerous presence (e.g., see Patent Document 1).

What is more, not just in golf as discussed above—in all sorts of sports and exercise, such as tennis, baseball, swimming, and yoga—movement of the shoulder blades that accompanies pivoting and motion of the arms is frequent. For example, in golf and tennis, when the club or racket is swung, right—left asymmetrical movement of the shoulder blades caused by pivoting of the trunk takes place, while with poses in yoga, bilateral symmetrical movement of the shoulder blades caused by symmetrical moving of both arms takes place.

Such movement of the shoulder blades is in most cases not either the right or left shoulder blade moving independently, but the right and left shoulder blades moving cooperatively. Nevertheless, with typical athletic clothes in any case doing nothing more than bracing the upper-body posture of the wearer by means of tensioning areas which, with respect to a main-body section that has elasticity, have higher tensioning force, sufficient consideration has not been given to cooperative movement of the left and right shoulder blades. Accordingly, with these typical athletic garments, sufficiently improving athletic performance in the variety of movements that accompany pivoting of the trunk and motion of the arms has been problematic.

Against this backdrop as such, athletic wear 1000 as illustrated in FIG. 1 and FIG. 2 is disclosed in Patent Literature 1. FIG. 1 and FIG. 2 are, respectively, a front-side view and a rear-side view of the athletic wear 1000. The athletic wear 1000 is athletic wear enabling sufficient improvement in athletic performance in the various movements that accompany pivoting of the trunk and motion of the arms.

The athletic wear 1000 is provided with a main-body section 110 that closely fits the upper half of the wearer's body, and tensing pieces 120 stitched into the outer sides of the main-body section 110. The main-body section 110 is composed of a front waist 111 and a rear waist 112, a collar section 113, and sleeve sections 114. The tensioning pieces 120 are composed of first tensioning sections 121, a second tensioning section 122, and third tensioning sections 123, formed on the rear waist 112, and of fourth tensioning sections 124, formed on the front waist 111. The first tensioning sections 121 through fourth tensioning sections 124, by causing their tensioning force to act, function to support the wearer's muscles and skeletal structure in the areas on which the first tensioning sections 121 through fourth tensioning sections 124 lie.

By means of the athletic wear 1000 when being worn, tensioning force from the first tensioning sections 121 acts on the shoulder blades and the muscle groups surrounding the shoulder blades, supporting in a spread-out way the regions where the shoulder blades are mobile when the wearer performs pivoting of the trunk and movement of the arms. Meanwhile, tensioning force from the first tensioning section 121 on one side is transmitted via the second tensioning section 122 to the first tensioning section 121 on the other side. Therefore, movement of the shoulder blade on the other side cooperating with movement of the shoulder blade on the one side is boosted further, making the range through which the shoulder blades are mobile all the more broadened. Accordingly, with the athletic wear 1000, flexibility in and around the shoulders when the left and right shoulders move cooperatively is effectively heightened, enabling improvement to be realized in the performance of movement of every sort that accompanies pivoting of the trunk and motion of the arms.

PRECEDENT TECHNICAL LITERATURE

Patent Documents

Patent Document 1: Japanese Patent No. 4061336

SUMMARY OF INVENTION

Issues Invention is to Resolve

According to the athletic wear 1000 described above, due to the action of first tensioning sections 121 through fourth tensioning sections 124, flexibility in and around the shoulders when the left and right shoulders move cooperatively is effectively heightened, thereby improving the performance of movement of every sort that accompanies pivoting of the trunk and motion of the arms. Nevertheless, bettering athletic performance is not just a matter of heightening flexibility in and around the shoulders. The inventors in the present application, based on approaches (concepts) that differ fundamentally from those to date, discovered techniques for improving performance of movement and arrived at the present invention.

A principal object of the present invention, brought about taking such points into consideration, is to make available clothing that supports the wearer's muscles to enable capacity for and flexibility in movement to be improved in situations such as during sports, during heavy lifting, or being under nursing care.

Means for Resolving the Issues

Clothing involving the present invention—clothing for covering the body of a wearer—is furnished with an upper-body piece for covering at least a portion of the upper half of the body, and an upper-body support unit formed on the upper-body piece. The upper-body support unit includes an upper-body first support section situated in a site following at least a portion of the psoas major muscle, an upper-body second support section situated in a site following the supraspinatus muscle, and an upper-body third support section situated in a site following the teres major muscle.

In a preferred embodying mode, the upper-body support unit further includes an additional upper-body support section. The additional upper-body support section is disposed extending from a starting point to an infraumbilical site, where a point shifted toward a location on the left ribs, with the site of the solar plexus being a reference, is taken as the starting point.

In a preferred embodying mode, the width of the upper-body first support section, the width of the upper-body second support section, and the width of the upper-body third support section are each not greater than 50 mm.

In a preferred embodying mode, the width of the upper-body first support section, the width of the upper-body second support section, and the width of the upper-body third support section are each between at least 1 mm and not greater than 25 mm.

In a preferred embodying mode, the upper-body first support section, the upper-body second support section and the upper-body third support section are each disposed in a mirror-symmetrical geometry.

In a preferred embodying mode, the upper-body support unit is constituted from a taping medium affixed to at least either the front side or the rear side of the upper-body piece.

In a preferred embodying mode, the taping medium is an adhesive tape on one side of which a heat-activated adhesive is applied.

In a preferred embodying mode, the adhesive tape is bonded to the rear side of the upper-body piece by heating. Further, the adhesive tape is anchored to the upper-body piece by being sewn with thread.

In a preferred embodying mode, the upper-body support unit is constituted integrally with material constituting the upper-body piece.

In a preferred embodying mode, the upper-body piece has the form of a T-shirt.

Clothing involving the present invention—clothing for covering the body of a wearer—is furnished with a lower-body piece for covering at least a portion of the lower half of the body, and a lower-body support unit formed on the lower-body piece. The lower-body support unit includes a lower-body first support section situated in a site following at least a portion of the psoas major muscle, a lower-body second support section situated in a site following the iliacus muscle, and a lower-body third support section situated in a site following the piriformis muscle.

In a preferred embodying mode, the width of the lower-body first support section, the width of the lower-body second support section, and the width of the lower-body third support section are each not greater than 50 mm.

In a preferred embodying mode, the lower-body support unit is constituted from a taping medium affixed to at least either the front side or the rear side of the lower-body piece.

Clothing involving the present invention—clothing for covering the body of a wearer—is furnished with an upper-body piece for covering at least a portion of the upper half of the body, a lower-body piece for covering at least a portion of the lower half of the body, an upper-body support unit formed on the upper-body piece, and a lower-body support unit formed on the lower-body piece. The upper-body support unit includes an upper-body first support section situated in a site following at least a portion of the psoas major muscle, an upper-body second support section situated in a site following the supraspinatus muscle, and an upper-body third support section situated in a site following the teres major muscle. The lower-body support unit includes a lower-body first support section situated in a site following at least a portion of the psoas major muscle, a lower-body second support section situated in a site following the iliacus muscle, and a lower-body third support section situated in a site following the piriformis muscle.

Clothing involving the present invention—clothing for covering the body of a wearer—is furnished with upper and lower clothing core pieces for covering at least a portion of the upper half of the body and at least a portion of the lower half of the body, and with support units formed on the upper and lower clothing core pieces. The support units include first support sections situated in sites following the psoas major muscles, second support sections situated in sites following the iliacus muscles, upper-body second support sections situated in sites following the supraspinatus muscles, upper-body third support sections situated in sites following the teres major muscles, and lower-body third support sections situated in sites following the piriformis muscles.

Clothing involving the present invention—clothing for covering the body of a wearer—is furnished with a clothing core piece for covering at least the navel and environs, and a support unit formed on the clothing core piece. The support unit includes a first support section situated in a site following the psoas major muscle, a second support section situated in a site following the iliacus muscle, and a third support section situated in a site following the piriformis muscle.

Clothing involving the present invention—clothing for covering the body of a wearer—is furnished with an upper-body piece for covering at least a portion of the upper half of the body, and an upper-body support unit formed on the upper-body piece. The upper-body support unit includes an upper-body second support section situated in a site following the supraspinatus muscle, and an upper-body third support section situated in a site following the teres major muscle.

In a preferred embodying mode, the width of the upper-body second support section and the width of the upper-body third support section are each not greater than 50 mm.

In a preferred embodying mode, the upper-body second support section and the upper-body third support section are each disposed in a mirror-symmetrical geometry.

In a preferred embodying mode, the upper-body support unit is constituted from a taping medium affixed to at least either the front side or the rear side of the upper-body piece.

In a preferred embodying mode, the upper-body support unit is constituted integrally with material constituting the upper-body piece.

A manufacturing method involving the present invention is a method of manufacturing support clothing for supporting a wearer's capacity for movement, and includes: a step of affixing a first support tape strip to a site following the psoas major muscle on at least either the front side or the rear side of a wearer's garment; a step of affixing a second support tape strip to a site following the iliacus muscle on at least either the front side or the rear side of the garment; a step of affixing a third support tape strip to a site following the supraspinatus muscle on at least either the front side or the rear side of the garment; a step of affixing a fourth support tape strip to a site following the teres major muscle on at least either the front side or the rear side of the garment; and a step of affixing a fifth support tape strip to a site following the piriformis muscle on at least either the front side or the rear side of the garment.

In a preferred embodying mode, the width of the first through fifth support tape strips is not greater than 50 mm, and the support clothing is utilized on an occasion selected from the group consisting of a sports occasion, a heavy-lifting occasion, and an occasion of being under nursing care.

In a preferred embodying mode, the first through fifth support tape strips are adhesive tape strips on one side of which a heat-activated adhesive is applied. Said affixing steps are carried out by heating the strips with an iron.

In a preferred embodying mode, the first through fifth support tape strips are affixed by being sewn with thread.

In a preferred embodying mode, a step of affixing added support tape defining an additional upper-body support section is included. The additional upper-body support section is disposed extending from a starting point to an infraumbilical site, where a point shifted toward a location on the left ribs, with the site of the solar plexus being a reference, is taken as the starting point.

Effects of Invention

According to clothing of the present invention, on an upper-body piece for covering at least a portion of the upper half of the body, an upper-body support unit is formed, with the upper-body support unit including an upper-body first support section situated in a site following at least a portion of the psoas major muscle, an upper-body second support section situated in a site following the supraspinatus muscle, and an upper-body third support section situated in a site following the teres major muscle, thereby activating the muscles by their being supported, so that the natural, Conception-Vessel, and Governing-Vessel meridians can be made to flow spontaneously. As a result, the wearer's muscles are supported in situations such as during sports, during heavy lifting, or being under nursing care, making improved capacity for and flexibility in movement possible. In addition, by combining with clothing (lower-body clothes) in which on a lower-body piece for covering at least a portion of the lower half of the body, a lower-body support unit is formed—with the lower-body support unit including a lower-body first support section situated in a site following at least a portion of the psoas major muscle, a lower-body second support section situated in a site following the iliacus muscle, and a lower-body third support section situated in a site following the piriformis muscle—in the lower half of the body, in the same way as with the upper half of the body, the muscles are activated by their being supported, so that the natural, Conception-Vessel, and Governing-Vessel meridians can be made to flow spontaneously. What is more, the lower-body third support section situated in a site following the piriformis muscle facilitates maintaining one's up-and-down and front-and-back balance.

BRIEF DESCRIPTION OF DRAWINGS

FIG. 26 is a table presenting experimental results in comparison examples and embodiment examples.

FIGS. 27 (*a*-1), 27 (*a*-2), 27 (*b*-1), 27 (*b*-2), 27 (*c*-1), 27 (*c*-2), 27 (*d*-1), 27 (*d*-2), 27 (*e*-1) and 27 (*e*-2) are photographs in lieu of drawings, illustrating results in the comparison examples and embodiment examples.

FIG. 28 is an evaluation sheet used in evaluating the comparison examples and embodiment examples.

FIGS. 29 (*a*), 29 (*b*) and 29 (*c*) are tables presenting experimental results in the comparison examples and embodiment examples.

FIG. 35 is a table presenting experimental results in comparison examples and embodiment examples.

MODES FOR EMBODYING INVENTION

Figure 1:
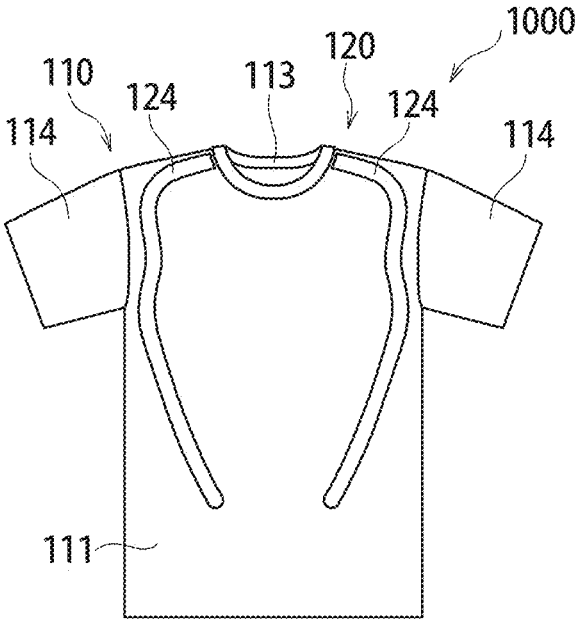
FIG. 1 is a front-side view of conventional athletic wear 1000.
Figure 2:
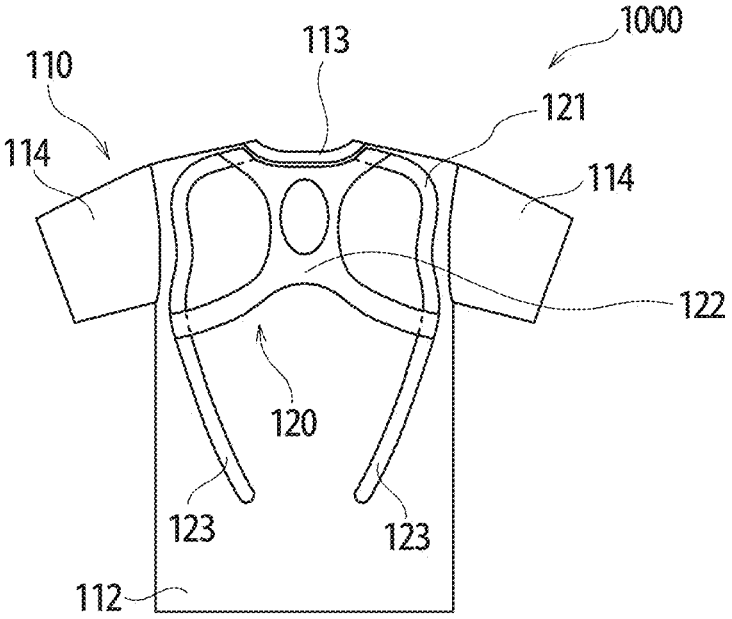
FIG. 2 is a rear-side view of the conventional athletic wear 1000.

Prior to an explanation of details of modes of embodying the present invention being made, particular circumstances under which the inventors in the present application discovered clothing as well as techniques for movement capacity improvement (also, body functioning betterment) involving the present invention will be explained. The inventors in the present application undertook dedicated studies regarding whether ordinary T-shirts as opposed to heavy-duty athletic wear 1000 as illustrated in FIG. 1 and FIG. 2 could be utilized to better functioning of the body. From among various studies, they realized that affixing tape (therapeutic/fitness tape, as tape having just the right tension) to predetermined sites on a T-shirt could serve in the betterment of body functioning (movement capacity improvement).

Figure 3A:
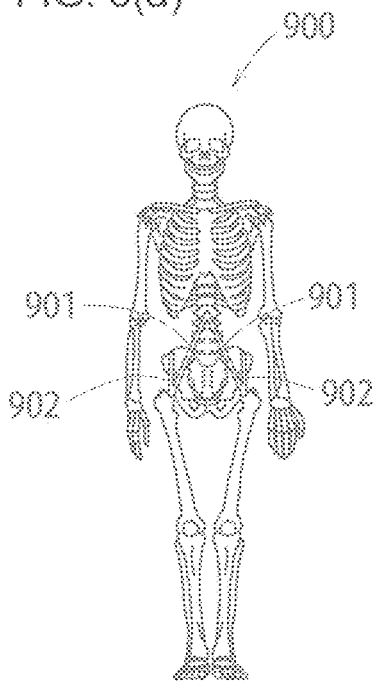
FIGS. 3 (*a*), 3(*b*) and 3 (*c*) respectively are a front-side view, lateral view, and rear-side view of the skeleton of a human 900.
Figure 3B:
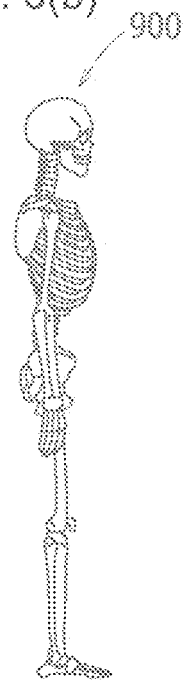
Figure 3C:
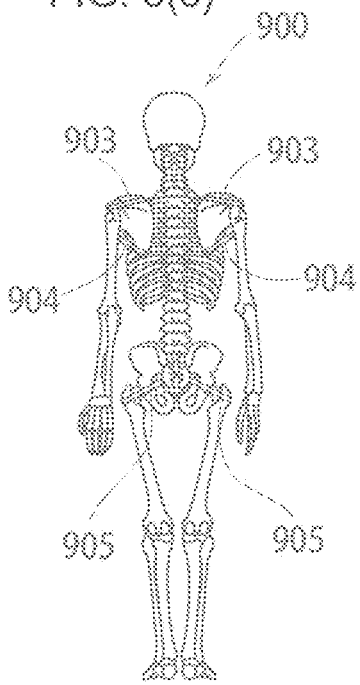

FIG. 3 (*a*) through (*c*) are a front-side view, lateral view, and rear-side view illustrating the skeleton of a human 900. The inventors in the present application affixed tape (commercial therapeutic tape) onto clothes (T-shirts as well as other shirts, and trousers). Specifically, they affixed tape (herein, gummed tape or therapeutic tape) in sites following the psoas major muscles 901, in sites following the iliacus muscles 902, in sites following the supraspinatus muscles 903, in sites following the teres major muscles 904, and in sites following the piriformis muscles 905. In doing so, they recognized any number of improvements in physical capacity (including, for example, improvement in flexibility, and improvement in capacity for movement). Specifics of the improvement in physical capacity will be discussed later.

As to why affixing tape in these sites improves physical capacity, the inventors in the present application, not ascertaining the precise reasons, surmised that it may be something along the lines of the following, which is, however, not more than a hypothesis. The sites (901-905) where the tape is affixed are sites in the musculature corresponding to the meridians. The Conception Vessel (rèn mài) and Governing Vessel (dū mài), which pass through the very middle of a human being, may be cited as meridians of primary importance. The Conception Vessel, a radial vessel belonging to the Extraordinary Vessels, runs along the body's anterior median line. The Governing Vessel, likewise a radial vessel belonging to the Extraordinary Vessels, runs along the body's posterior median line.

Figure 4A:
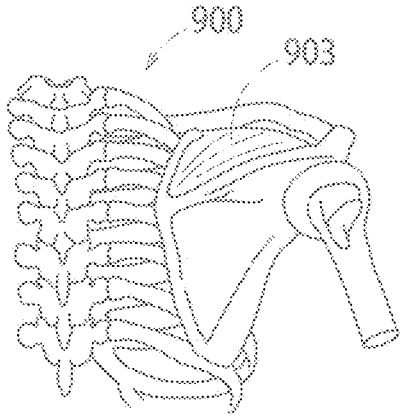
FIGS. 4 (*a*) and 4 (*b*) respectively are diagrams illustrating the musculature of a supraspinatus muscle 903 and a teres major muscle 904.
Figure 4B:
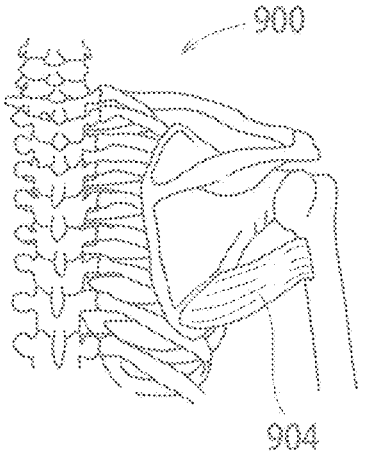
Figure 5A:
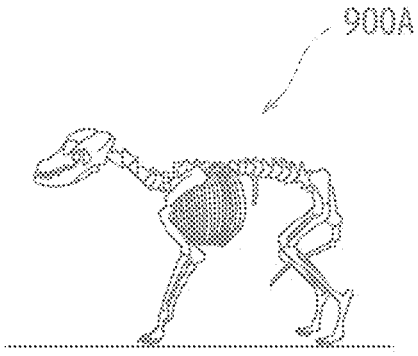
FIGS. 5 (*a*) and 5 (*b*) respectively are diagrams of the skeleton of an animal 900A, and of the human 900 assuming an on-all-fours pose.
Figure 5B:
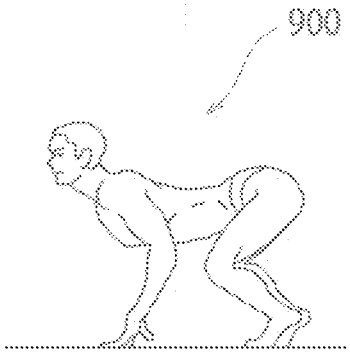

Herein, in the upper body half, the muscles corresponding to the Conception Vessel are the supraspinatus muscles 903, while the muscles corresponding to the Governing Vessel are the teres major muscles 904. FIGS. 4 (*a*) and (*b*) respectively illustrate the musculature of a supraspinatus muscle 903 and a teres major muscle 904. Now it is theorized that affixing tape to clothing where it corresponds to these muscles (903 and 904) can be an assist whereby the muscles are activated, so that as a result the natural, Conception-Vessel, and Governing-Vessel meridians flow spontaneously. Further, the inventors in the present application deduced where in the body lower half (the legs) the equivalents are of the muscles involved in the thus-conceived movements. FIGS. 5 (*a*) and (*b*) respectively are diagrams of the skeleton of an animal 900A, and of the human 900 assuming an on-all-fours pose.

Figure 6:
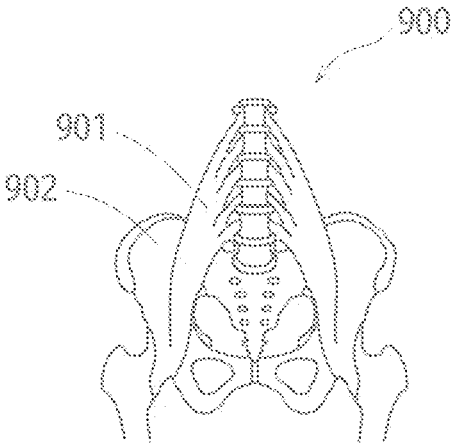
FIG. 6 is a diagram illustrating the musculature of an iliacus muscle 902 and a psoas major muscle 901.

Still further, looking at the forelegs as the upper body and looking at the hindlegs as the lower body led to conceiving correspondences of the following sort. Namely, the shoulder blades (upper body) correspond to the ilia (lower body); the shoulder joints (upper body), to the hip joints (lower body); the elbows (upper body), to the knees (lower body) and the wrists (upper body), to the ankles (lower body). Then, in the lower body (hindlegs), what corresponds to the supraspinatus muscles 903 and the teres major muscles 904 are respectively the iliacus muscles 902 and the psoas major muscles 901. FIG. 6 is a diagram illustrating the musculature of an iliacus muscle 902 and a psoas major muscle 901. Affixing tape in these sites can lend the sensation of an axis passing through the very middle of the body (the Conception Vessel and Governing Vessel). To liken this: In the martial arts, in situations in which techniques are applied not relying on power but only handling, the state may be thought of as the balance among emotions, thoughts, and the corporeal body being in order, and in such an ordered state, when nursing care is attempted it can be possible to lift a patient up lightly without using much power; wherein what is embodied by means of the technique according to which tape is affixed to the given sites is imagined to resemble a state of this sort.

Figure 7:
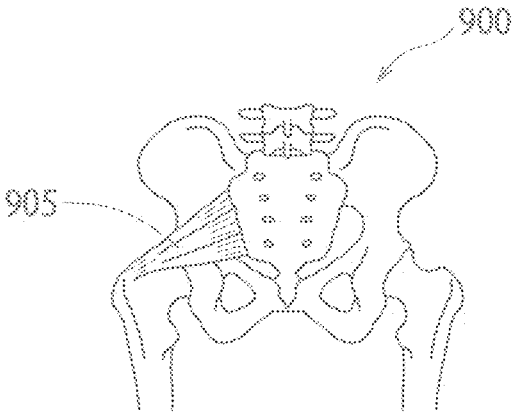
FIG. 7 is a diagram illustrating the musculature of a piriformis muscle 905.

In addition, when tape is applied to the iliacus muscles 902 and psoas major muscles 901 (the two together will also at times be referred to as the "iliopsoas muscle") the formation of the body's axis will arise, yet the sense of being tugged by an attractive force could prove strong (for example, if one jumps, strongly feeling the force of landing). As a way of dealing with that, the idea of fixing tape onto sites of the piriformis muscles was hit upon. FIG. 7 is a diagram illustrating the musculature of a piriformis muscle 905. It was recognized that by addedly applying tape to the piriformis muscles 905, maintaining one's up-and-down and front-and-back balance is facilitated.

Hereinafter, referring to the drawings an explanation of preferred modes of embodying the present invention will be made. Below in the drawings, for the sake of making the explanation concise, elements and regions exhibiting the same acting effects are labeled with the same reference numbers, and reduplicating description in some instances will be either omitted or abbreviated. Furthermore, in the diagrams the dimensional relationships (length, width, thickness, etc.) in some cases do not necessarily reflect the actual dimensional relationships accurately. Nevertheless, the dimensional relationships as in diagrams including FIG. 8 and FIG. 9, FIG. 10 and FIG. 11, FIG. 12 and FIG. 13, and FIG. 14 and FIG. 15 have been made coincident, and in those cases, from the dimensions and positional relationships in the diagrams it is possible to derive the six primary views. It will be appreciated that inasmuch as the subject is clothing (clothes) thickness in the six primary views often may be ignored.

Further, particulars that are necessary for implementing the present invention and are matters apart from the particulars specifically referred to in the present specification can be apprehended to be particulars of design for the person skilled in the art, based on conventional technology in the given field. The present invention can be implemented based on the content disclosed by the present specification and drawings, and on common technical knowledge in the given field. What is more, the present invention is not limited to the following embodying modes.

Figure 8:
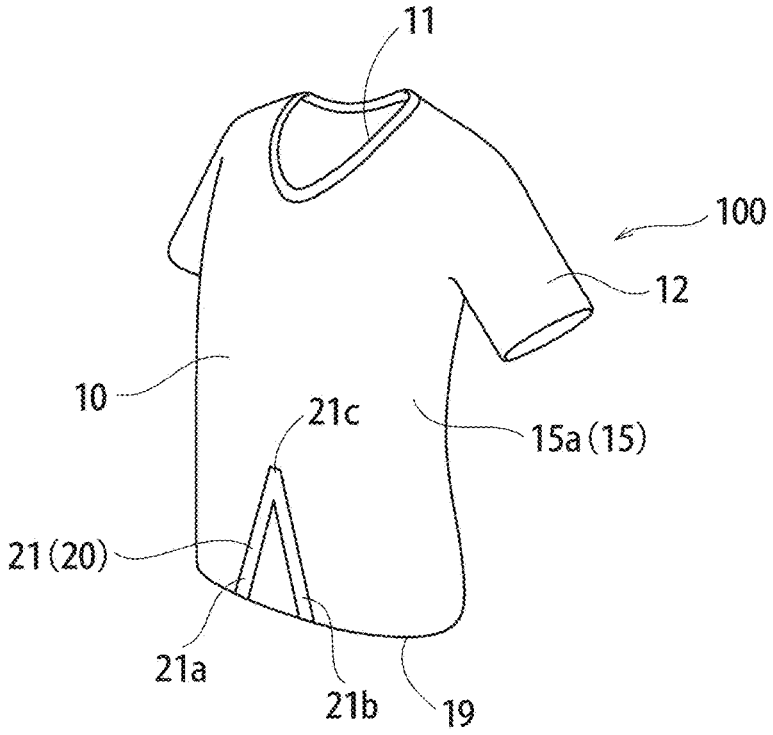
FIG. 8 is a perspective view illustrating the front-side configuration of clothing (a shirt) 100 involving a mode of embodying the present invention.
Figure 9:
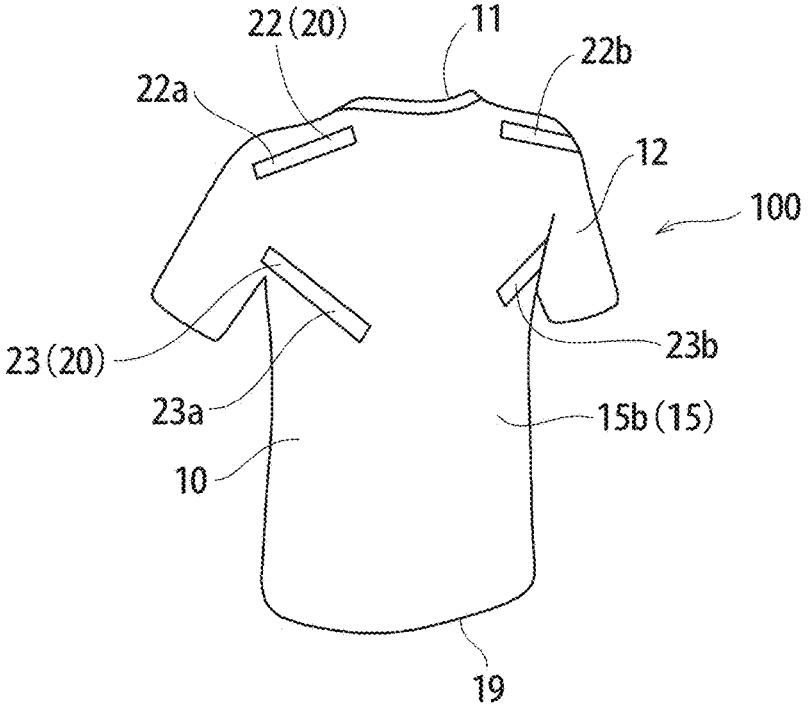
FIG. 9 is a perspective view illustrating the rear-side configuration of the clothing (shirt) 100 involving the present-invention embodying mode.

FIG. 8 and FIG. 9 are perspective views illustrating the configuration of clothing (a shirt) 100 involving a mode of embodying the present invention. FIG. 8 and FIG. 9 respectively illustrate the front-side configuration and the rear-side configuration of the clothing (shirt) 100 involving the present embodying mode. The clothing 100 of the present embodying mode is clothing for covering the body of a wearer and has the configuration of a shirt (the illustrated example being a T-shirt).

The shirt 100 of the present embodying mode comprises an upper-body piece 10 for covering at least a portion of the upper half of the body. In the present embodying mode, the upper-body piece 10 constituting the shirt 100 is composed of a trunk portion 15 consisting of a front waist 15*a* and a rear waist 15*b*, a collar section 11, and sleeve sections 12. In this example, the lower edge 19 of the trunk portion 15 is situated along the periphery of the loins or the groin. Since the shirt 100 (upper-body piece 10) of the present embodying mode is in the form of a T-shirt, the collar section 11 is round-necked and not a collar such as on ordinary shirts (for example, dress shirts), but there may be a collar. Likewise, the sleeve sections 12 are short sleeves, but the shirt may be of such morphology as long-sleeved, three-quarter sleeved (or elbow-length sleeved), or sleeveless. While a trunk portion 15 in which a front waist 15*a* and a rear waist 15*b* are stitched together is readily fabricated, it may equally well be a seamless, unitary item.

The material constituting the upper-body piece 10 of the present embodying mode is fabric typically employed for clothing and has elasticity suitable for clothing. It should be understood that elasticity herein means what is a property suited to clothing, not what especially demands the restorative capability of rubber (elastomers). Examples that can be cited of the material (fabric) constituting the shirt 100 (upper-body piece 10) are: natural-fiber textiles (e.g., cotton fiber (cottons), silk fiber (silks), etc.), and synthetic-fiber textiles (e.g., polyester fiber, etc.), as well as textiles blended from natural-fiber textiles and synthetic-fiber textiles (e.g., polyester-and-cotton mixed yarns, etc.), and blended textiles of a plurality of kinds (e.g., nylon-polyurethane fiber, rayon fiber-acrylic fiber-polyester fiber, acrylic fiber-polyester fiber-rayon fiber-polyurethane fiber, etc.). It should be noted that in instances where the shirt is not a T-shirt (for example, is a shirt such as a polo shirt), materials such as linen and sheep's wool furthermore can be employed.

In the clothing (shirt) 100 of the present embodying mode, an upper-body support unit 20 is formed on the upper-body piece 10 (or on the material constituting the upper-body piece 10—herein, on the material constituting the T-shirt). In the configuration of the present embodying mode, the upper-body support unit 20 is composed from: an upper-body first support section 21 situated in sites following at least a portion of the psoas major muscles ("901" in FIG. 3(*a*)); an upper-body second support section 22 situated in sites following the supraspinatus muscles ("903" in FIG. 3(*c*)); and an upper-body third support section 23 situated in sites following the teres major muscles ("904" in FIG. 3(*c*)). The upper-body support unit of the present embodying mode, imparting the feel of tape (or cloth) having been applied, activates and assists the muscles. Such feel of tape (or cloth) having been applied can be created by bonding tape elements to the upper-body piece 10. It should be noted that the tape elements for imparting this sort of feel may be contracting products (compression tape), or may be non-contracting products (gummed tape, therapeutic tape, or products akin to these).

The upper-body first support section 21 of the present embodying mode is constituted from a pair of rectangularly shaped structures (strip pieces) 21*a* and 21*b* that extend along a portion of the psoas major muscles (901). The pair of strip pieces 21*a* and 21*b* extend downward from a point 21*c* which corresponds to the location that is the starting point of the upper end of the psoas major muscles. In the example illustrated in FIG. 8, the pair of strip pieces 21*a* and 21*b* do not extend as far as the bottom end of the psoas major muscles. Nevertheless, the upper-body piece 10 may be lengthened downward, and the pair of strip pieces 21*a* and 21*b* may be further extended downward so as to follow the entirety of the psoas major muscles.

The upper-body second support section 22 of the present embodying mode is constituted from a pair of rectangularly shaped structures (strip pieces) 22*a* and 22*b* that extend along the supraspinatus muscles (903). Being that the strip pieces 22*a* and 22*b* extend along the supraspinatus muscles (903), preferably they are formed to extend from end to end (from the start point to the end point) of the supraspinatus muscles. And while depending on the wearer's figure there will be cases where they are not formed to follow the entirety of the supraspinatus muscles (903), to the extent possible they preferably are created putting together a lineup of sizes (or otherwise made to order) in forms such that the one end and the other end of the supraspinatus muscles (the start point and the end point (or the origin area and the terminal area)) may correspond to the start point and the end point of the strip pieces 22*a* and 22*b*.

The upper-body third support section 23 of the present embodying mode is constituted from a pair of rectangularly shaped structures (strip pieces) 23*a* and 23*b* that extend along the teres major muscles (904). Being that the strip pieces 23*a* and 23*b* extend along the teres major muscles (904), preferably they are formed to extend from end to end (from the start point to the end point) of the teres major muscles. And while depending on the wearer's figure there will be cases where they are not formed to follow the entirety of the teres major muscles (904), to the extent possible they preferably are created putting together a lineup of sizes (or otherwise made to order) in forms such that the one end and the other end of the supraspinatus muscles (the start point and the end point) may correspond to the start point and the end point of the strip pieces 23*a* and 23*b*.

In the present embodying mode, the upper-body first support section 21, the upper-body second support section 22, and the upper-body third support section 23 are constituted from a taping medium. The upper-body first support section 21, the upper-body second support section 22, and the upper-body third support section 23, constituted from the taping medium, impart the sense of tape (or cloth) having been applied to the sites of the given muscles (901, 903, and 904) on the clothing (shirt) 100, whereby the given muscles (901, 903, and 904) can be stimulated and assisted by their being activated. In one example of the present embodying mode, the upper-body first support section 21, the upper-body second support section 22, and the upper-body third support section 23 are constructed by affixing taping media to the obverse surface (the exposed surface) of the upper-body piece 10. Likewise, the upper-body first support section 21, the upper-body second support section 22, and the upper-body third support section 23 can be constructed affixing taping media to the reverse surface (the body-side surface) of the upper-body piece 10.

It will be appreciated that constructing the upper-body first support section 21, the upper-body second support section 22, and the upper-body third support section 23 by affixing taping media to both the obverse surface and the reverse surface of the upper-body piece 10 is also possible.

In the present embodying mode, the taping medium that constitutes the upper-body support unit 20 is, for example, Kinesio® tape. It should be noted that Kinesio® tape is one among tapes for taping to aid in treatment of affected areas according to the Kinesio Taping® method, that have about the same stretch as muscles, and that rather than immobilize the affected area, can be applied to follow overextended or over-contracted muscles (commercial products include those made by Pip Co., Ltd., Nichiban Co., Ltd., and Nitoms, Inc.). And for the taping medium that constitutes the upper-body support unit 20, multipurpose sports tapes are available—for example, "CLEAR" multipurpose sports tape employing 40-denier cotton cloth with a cutaneous feel (manufactured by Mysvdena Japon Co., Ltd.). It should be noted that there are examples of employing Kinesio® tape by applying it directly to the skin in order to confirm the presence of effectiveness.

Furthermore, as examples of taping media constituting the upper-body support unit 20 in the present embodying mode, therapeutic tape (or masking tape) can be cited. Therapeutic tape is adhesive tape composed of polyester (or a backing material such as polyethylene-coated cloth or glass cloth), and has almost no elasticity (as one example, the thickness of therapeutic tape is 0.16 mm, and its adhesive force is 4.8 N/10 mm and its tensile strength is 54 N/10 mm). Also, "Titan Tape" (97% cotton, 3% polyurethane; manufactured by Phiten Co., Ltd.) for example, can be employed for the taping medium constituting the upper-body support unit 20. In experiments by the inventors in the present application, (1) Kinesin® tape as well as multipurpose sports tape, (2) therapeutic tape, and (3) Titan Tape, in that order, were found to be effective. Furthermore, the effectiveness, as taping media constituting the upper-body support unit 20, of pieces cut from an anti-slip mat as well as pieces cut from a desk-mat sort of plastic material was confirmed according to experiments by the inventors in the present application. And the above-described examples are illustrative; there are no restrictions on substance/type/dimensions/form, etc. as long as they are suited for the taping medium that constitutes the upper-body support unit 20. Not just taping-material products—athletic supporters that are cut and worked into taping media are also adequate. It should be noted that therapeutic tape, pieces cut from an anti-slip mat, pieces cut from a desk-mat sort of plastic material, gummed tape, etc. were effective in instances where they were applied along the outer side of the shirt (instances where they were affixed to the outer, obverse surface of the shirt). Likewise, instances where these sorts of taping media were applied on the inner side of the shirt (instances where they were affixed to the inner surface of the shirt) had as shirts the drawback of not being comfortable to wear.

As a taping medium constituting the upper-body support unit 20 in the present embodying mode, a material that is more contractile than that constituting the upper-body piece 10 is preferable (for example, Kinesio® tape or elastic tape). In instances where the taping medium for constituting the upper-body support unit 20 does not have contractility (for example, therapeutic tape or gummed tape), that the tensile strength of the material be at least 18 N/10 mm (one preferred example being at least 40 N/10 mm) is preferable (in a single example, 54 N/10 mm (therapeutic tape)). As the taping medium that constitutes the upper-body support unit 20, in instances where, as material not having contractility, gummed tape (cloth tape) is utilized the tensile strength is, e.g., 48 N/10 mm, while in instances where gummed tape (kraft tape, paper tape (kraft adhesive tape)) is utilized the tensile strength is, e.g., 19.5 N/10 mm.

The width of the upper-body first support section 21, the width of the upper-body second support section 22, and the width of the upper-body third support section 23 of the present embodying mode each can be made, for example, not greater than 50 mm (preferably 25 mm to 1 mm). Techniques investigated by the inventors in the present application include applying the taping medium constituting the upper-body support unit 20 with an exclusive focus on the end portions (the origin area and the terminal area) on either side of the corresponding muscle (for example, a technique of applying the material in 1 cm to 2 cm squares), which proves effective (in particular, the supraspinatus muscles (903) and the teres major muscles (904); with the psoas major muscles (901), the origin areas). Here, preferred widths for the taping medium (21, 22, 23) tend toward the relatively slender (widths on an order corresponding to the muscle—e.g., 1 mm to 10 mm) rather than overly broad widths. This is inferred to be because setting the taping medium constituting the upper-body support unit 20 pinpointedly onto the corresponding muscle brings about a modulating effect (concentrating, as opposed to blurring, power), resulting in a more secure support for muscle movement. Experiments conducted by the inventors in the present application ascertained that the effectiveness of the taping medium constituting the upper-body support unit 20 rose in the order: therapeutic-tape width (50 mm), half that width (25 mm), and pinpointed width (10 mm or less). It should be understood that taping media that exceed 50 mm in width defocus the media's stimulation of the muscles (muscle activation), such that 50 mm or less (preferably 25 mm or less) is better, but since suitably applying taping media to the appropriate muscles according to the person might be impractical, there can be situations where a technique is adopted such that taping media are applied over a broad range, at widths exceeding 50 mm or widths near that (e.g., 50 mm to 100 mm), slightly sacrificing effectiveness; making the widths a maximum 50 mm is, however, preferable.

Also, the taping medium (21, 22, 23) can be made a cloth textile (herein, cotton (e.g., interlock cotton 40)), and a heat-activated adhesive (or iron-on adhesive) can be coated onto the cloth face that is brought into contact with (fixed/adhered to) the surface (herein, the inner surface) of the upper-body piece 10 (shirt main-body section) and heated with a heater (herein, an iron) to bond (adhesively fix) the given taping medium to the upper-body piece 10 (shirt main-body section). In this case, the cloth fabric (contact face—cotton) comes into contact with and stimulates the skin, while the surface of the heat-activated adhesive is situated on the shirt side. It should be noted that the taping medium (21, 22, 23) may be sewn to bond it to (it may be anchored to) the upper-body piece 10 (shirt main-body section) so that even after being washed the taping medium (21, 22, 23) will not come off/slip out of place. In that case, fixing it once in place with an iron-on adhesive and then sewing it on with thread is handier.

In the configuration of the present embodying mode, the width of the upper-body first support section 21, the width of the upper-body second support section 22, and the width of the upper-body third support section 23 each can be made the same (e.g., a width such as 5 mm or 10 mm). The advantage in that case is that the taping media constituting the upper-body support unit 20 can be employed in common. By the same token, the width of the upper-body first support section 21, the width of the upper-body second support section 22, and the width of the upper-body third support section 23, rather than being made the same, may equally well differ. This is because varying the width of the upper-body first support section 21, the width of the upper-body second support section 22, and the width of the upper-body third support section 23 makes it possible that the movements of the different muscles can be further activated, and also because there can be instances where from the demands of design it is better that the widths be altered.

Meanwhile, given that the human body (skeleton and muscles) is fundamentally mirror-symmetrical, the upper-body first support section 21, the upper-body second support section 22, and the upper-body third support section 23 are respectively arranged in a mirror-symmetrical form. In reality, however, the roles of the muscles on the right side and the left side can be different (for example, in a right-handed person, the muscles for throwing, etc. with the right hand are developed), and in that respect, there are instances where it is preferable to dispose, in line with each individual, the upper-body first support section 21, the upper-body second support section 22, and the upper-body third support section 23 bilaterally asymmetrically, following the stream of the muscles on the right side and the left side. In addition, when for reasons such as the demands of design—as opposed to right—left differences (subtle differences in each individual) in location of the muscles—it is desired to render the support sections in a disposition that is not bilaterally symmetrical, making changes within the range in which the upper-body support unit 20 in the present embodying mode exhibits its functionality is possible. Further, for an upper-body support unit 20 in the present embodying mode, it is preferable to render the upper-body support unit 20 with the end portions being at either side (the origin area or the terminal area) of the corresponding muscles; but in cases where, given the demands of design and like reasons, altering its form is desired, making changes within the range in which the upper-body support unit 20 in the present embodying mode exhibits its functionality is possible.

Figure 10:
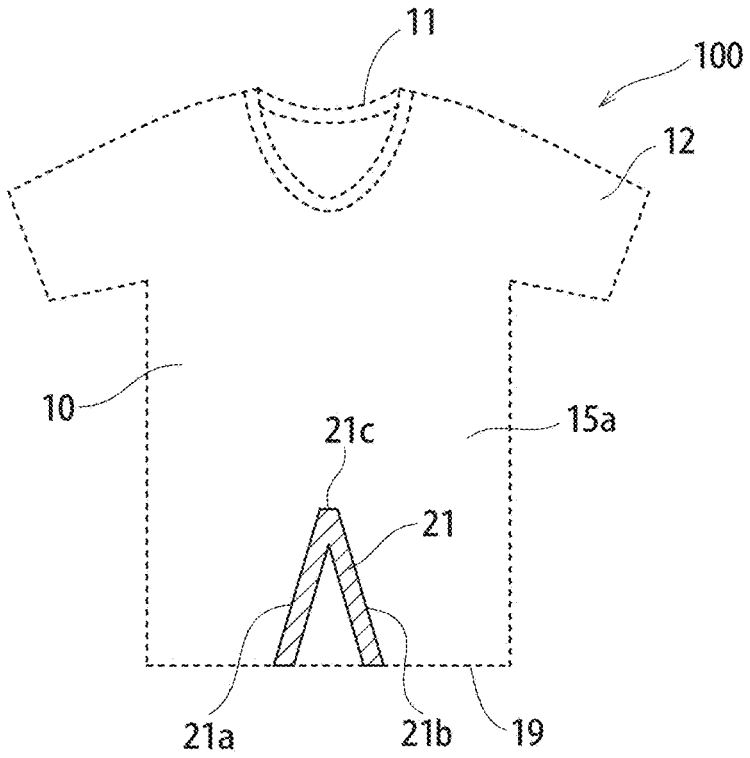
FIG. 10 is a front-side view illustrating supporting areas in the shirt 100 involving the present-invention embodying mode.
Figure 11:
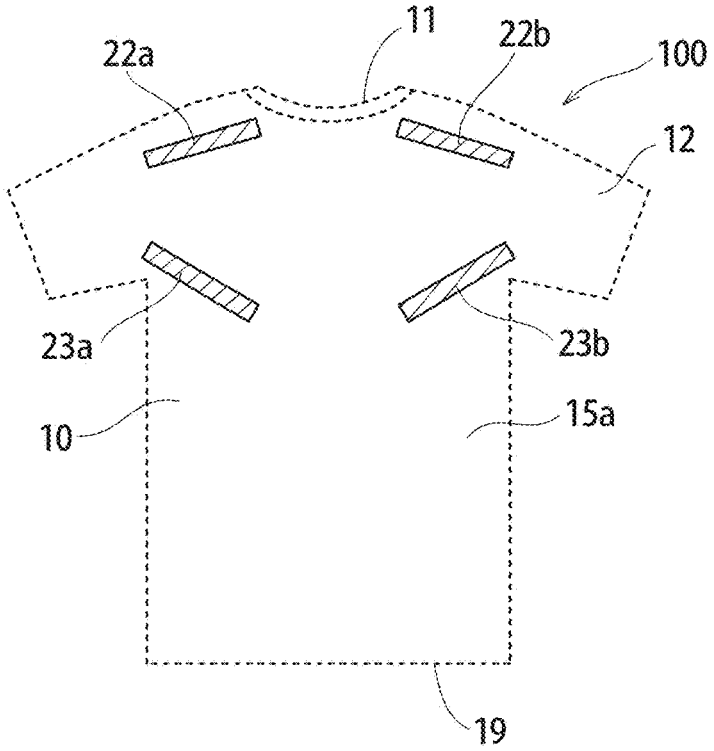
FIG. 11 is a rear-side view illustrating supporting areas in the shirt 100 involving the present-invention embodying mode.

FIG. 10 and FIG. 11 are a front-side view and a rear-side view illustrating supporting areas in the shirt 100 involving the present embodying mode. Within the figures, the diagonally hatched areas correspond to the supporting areas. Specifically, the supporting areas (diagonally hatched areas) correspond to the upper-body first support section 21 (the psoas major muscles 901), the upper-body second support section 22 (the supraspinatus muscles 903), and the upper-body third support section 23 (the teres major muscles 904). In the explanation set forth above, the upper-body support unit 20 (21, 22, and 23) was constructed from a taping medium but is not limited to that, as long as regions that are the supporting areas as illustrated in FIG. 10 and FIG. 11 may be created. For example, the supporting-area regions (or else tensioning-section regions, in implementations to have tightening force; elastic-section regions, in implementations to have extending/contracting force; or contraction regions, in implementations to have contracting force) can be created by altering the substance and the weave of the upper-body piece 10 constituting the shirt 100. In such implementations, the upper-body support unit 20 of the present embodying mode can be constituted integrally with the material constituting the upper-body piece 10. Also, the materials and components with which the supporting areas can be made may otherwise be arranged in the interior of the material constituting the upper-body piece 10. Alternatively, clothing (a shirt) 100 of the present embodying mode may be manufactured by forming storing sections such as pockets or the like in sites corresponding to the supporting areas (in sites on the obverse face, in the interior, or on the reverse face of the upper-body piece 10), and in those storing sections inserting items that may demonstrate a force that is supporting (a support force, or force that imparts the feel of being rested upon by tape or cloth). In addition, as long as supporting areas are formed in the manner illustrated in the drawings, supporting areas further may equally as well be formed in other locations. And the instance of creating the supporting areas by applying (e.g., fixing with an adhesive, glue-fixing, heat-activated adhering, sewing, etc.)

taping media can make not just sports shirts (T-shirts, tennis shirts, golf shirts, etc.), but also shirts such as ordinary dress shirts demonstrate the same beneficial effects.

Figure 12:
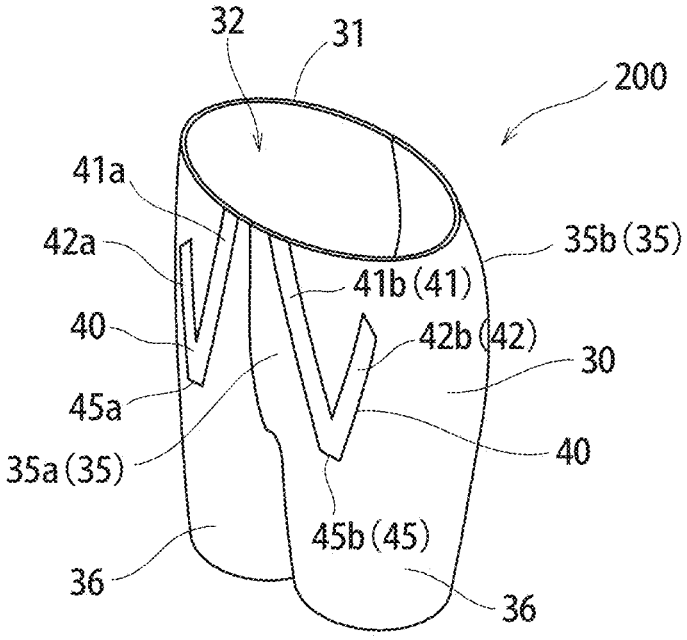
FIG. 12 is a perspective view illustrating the front-side configuration of clothing (pants) 200 involving a mode of embodying the present invention.
Figure 13:
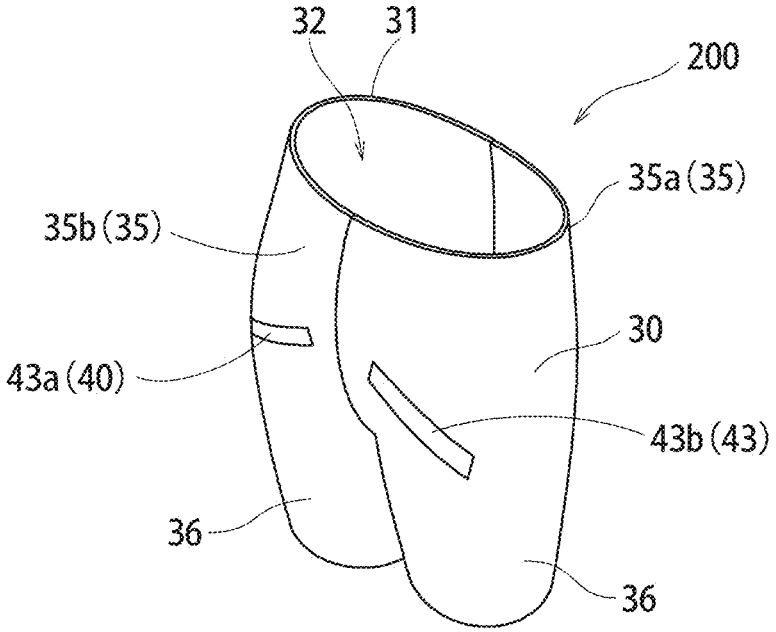
FIG. 13 is a perspective view illustrating the rear-side configuration of the clothing (pants) 200 involving the present-invention embodying mode.

FIG. 12 and FIG. 13 are perspective views illustrating the configuration of clothing (pants, trousers, or tights) 200 involving a mode of embodying the present invention. FIG. 12 and FIG. 13 respectively illustrate the front-side configuration and the rear-side configuration of the clothing (trousers/tights) 200 involving the present embodying mode. Clothing 200 of the present embodying mode is clothing for covering the body of a wearer, and has the configuration of trousers (in the illustrated example, breeches).

Clothing (trousers, or crotched clothing) 200 of the present embodying mode is furnished with a lower-body piece 30 for covering at least a portion of the lower half of the body. In the configuration of the present embodying mode, it is constituted from a waist section 31 that defines an opening 32 through which the trunk (principally, the abdomen and loins) enters, an above-crotch section 35 that clothes the lower-body trunk (the area around the abdomen and the groin), and a below-crotch section 36 that covers the legs. Since the trousers 200 (lower-body piece 30) of the present embodying mode have the form of breeches (shorts), the length of the below-crotch section 36 is short, but the below-crotch section 36 may be as far as the ankles (or the knees or the shins). Further, trousers 200 of the present embodying mode may be in the form of briefs without portions that cover the legs, and also may be a swimsuit. Still further, in the illustrated trousers 200, a mode in which the fabric on the right and left are joined together is represented, but the mode may be one in which the front waist 35*a* and the rear waist 35*b* of the trousers 200 are joined together, as well as a mode in which the trousers are assembled with other pants, and is not limited specifically to the illustrated configurations.

The material constituting the lower-body piece 30 in the present embodying mode is fabric typically employed for clothing and has elasticity suited for clothes. It should be understood that elasticity herein means what is a property suited to clothing, not what especially demands the restorative capability of rubber (elastomers). Examples that can be cited of the material (fabric) constituting the trousers 200 (lower-body piece 30) are: natural-fiber textiles (e.g., cotton fiber (cottons), silk fiber (silks), etc.), and synthetic-fiber textiles (e.g., polyester fiber, etc.), as well as textiles blended from natural-fiber textiles and synthetic-fiber textiles (e.g., polyester-and-cotton mixed yarns, etc.), and blended textiles of a plurality of kinds (e.g., nylon-polyurethane fiber, rayon fiber-acrylic fiber-polyester fiber, acrylic fiber-polyester fiber-rayon fiber-polyurethane fiber, etc.). Furthermore, materials such as linen and sheep's wool can be employed.

In the clothing (trousers) 200 of the present embodying mode, on the lower-body piece 30 (or on the material constituting the lower-body piece 30—herein, on the material constituting the breeches) a lower-body support unit 40 is formed. In the configuration of the present embodying mode, the lower-body support unit 40 is composed from: a lower-body first support section 41 situated in sites following at least a portion of the psoas major muscles ("901" in FIG. 3(*a*)); a lower-body second support section 42 situated in sites following the iliacus muscles ("902" in FIG. 3(*a*)); and a lower-body third support section (43) situated in sites following the piriformis muscles ("905" in FIG. 3(*c*)).

The lower-body first support section 41 of the present embodying mode is constituted from a pair of rectangularly shaped structures (strip pieces) 41*a* and 41*b* that extend along a portion of the psoas major muscles (901). The pair of strip pieces 41*a* and 41*b* extend upward from points 45 (45*a* and 45*b*) that correspond to the locations that are the starting points of the lower ends of the psoas major muscles. In the example illustrated in FIG. 12, the pair of strip pieces 41*a* and 41*b* do not extend as far as the upper end of the psoas major muscles. Nevertheless, the lower-body piece 30 may be lengthened upward, and the pair of strip pieces 41*a* and 41*b* may be further extended upward so as to follow the entirety of the psoas major muscles.

The lower-body second support section 42 of the present embodying mode is constituted from a pair of rectangularly shaped structures (strip pieces) 42*a* and 42*b* that extend along the iliacus muscles (902). Being that the strip pieces 42*a* and 42*b* extend along the iliacus muscles (902), preferably they are formed to extend from end to end (from the start point to the end point) of the iliacus muscles. And while depending on the wearer's figure there will be cases where they are not formed to follow the entirety of the iliacus muscles (902), to the extent possible they preferably are created putting together a lineup of sizes (or otherwise made to order) in forms such that the one end and the other end of the iliacus muscles (the start point and the end point (or the origin area and the terminal area)) may correspond to the start point and the end point of the strip pieces 42*a* and 42*b*. In addition, with configurations according to the present embodying mode, while one in which the pattern is that the lower-body first support section 41 and the lower-body second support section 42 are formed integrally is illustrated, the configuration may be formed by combining a lower-body first support section 41 pattern and a lower-body second support section 42 pattern.

The lower-body third support section 43 of the present embodying mode is constituted from a pair of rectangularly shaped structures (strip pieces) 43*a* and 43*b* that extend along the piriformis muscles (905). Being that the strip pieces 43*a* and 43*b* extend along the piriformis muscles (905), preferably they are formed to extend from end to end (from the start point to the end point) of the piriformis muscles. And while depending on the wearer's figure there will be cases where they are not formed to follow the entirety of the piriformis muscles (905), to the extent possible they preferably are created putting together a lineup of sizes (or otherwise made to order) in forms such that the one end and the other end of the piriformis muscles (the start point and the end point) may correspond to the start point and the end point of the strip pieces 43*a* and 43*b*.

In the present embodying mode, the lower-body first support section 41, the lower-body second support section 42, and the lower-body third support section 43 are constituted from a taping medium. The lower-body first support section 41, the lower-body second support section 42, and the lower-body third support section 43, constituted from the taping medium, impart the sense of tape (or cloth) having been applied to the sites of the given muscles (901, 902, and 905) on the clothing (shirt) 100, by which the support sections, stimulating the given muscles (901, 902, and 905), can assist them. In one example of the present embodying mode, the lower-body first support section 41, the lower-body second support section 42, and the lower-body third support section 43 are constructed by affixing taping media to the obverse surface (the exposed surface) of the lower-body piece 30. Likewise, the lower-body first support section 41, the lower-body second support section 42, and the lower-body third support section 43 can be constructed by affixing taping media to the reverse surface (the body-side surface) of the lower-body piece 30. It will be appreciated that constructing the lower-body first support section 41, the lower-body second support section 42, and the lower-body third support section 43 by affixing taping media to both the obverse surface and the reverse surface of the lower-body piece 30 is also possible.

For the taping medium constituting the lower-body support unit 40 in the present embodying mode, the same taping medium as that constituting the upper-body support unit 20 can be employed (for example, Kinesio® tape, sports tape, therapeutic tape, etc.) Nevertheless, it does not matter if what is employed for the taping medium constituting the lower-body support unit 40 and for the taping medium constituting the upper-body support unit 20 differ.

Also, the width of the lower-body first support section 41, the width of the lower-body second support section 42, and the width of the lower-body third support section 43 of the present embodying mode each can be made, for example, not greater than 50 mm (preferably 25 mm to 1 mm), and the same conditions as those for the width of the taping medium constituting the upper-body support section 20 can be used. Nevertheless, it does not matter if what are different conditions (numerical values) for the width of the taping medium constituting the lower-body support unit 40 and the width of the taping medium constituting the upper-body support unit 20 are employed. Similarly as with the explanation of the taping media constituting the upper-body support unit 20, with the lower-body support unit 40 also, a method of applying that focuses pointedly on the end portions (the origin area and the terminal area) on either side of the corresponding muscle is effective, while for the widths (41, 42, 43), those that are slenderer rather broader (widths on an order corresponding to the muscle—e.g., 1 mm to 10 mm) are effective. This is inferred to be because, in the same way as with the upper-body support unit 20, setting the taping medium constituting the lower-body support unit 40 pinpointedly onto the corresponding muscle brings about a modulating effect (concentrating, as opposed to blurring, power), resulting in a more secure support for muscle movement. Experiments conducted by the inventors in the present application ascertained that the effectiveness of the taping medium constituting the lower-body support unit 40 rose in the order: therapeutic-tape width (50 mm), half that width (25 mm), and pinpointed width (10 mm or less). It should be understood that taping media that exceed 50 mm in width defocus the media's stimulation of the muscles (muscle activation), such that 50 mm or less (preferably 25 mm or less) is better, but since suitably applying taping media to the appropriate muscles according to the person might be impractical, there can be situations where a technique is adopted such that taping media are applied over a broad range, at widths exceeding 50 mm or widths near that (e.g., 50 mm to 100 mm), slightly sacrificing effectiveness.

In the configuration of the present embodying mode, the width of the lower-body first support section 41, the width of the lower-body second support section 42, and the width of the lower-body third support section 43 each can be made the same (e.g., a width such as 5 mm or 10 mm). The advantage in that case is that the taping media constituting the lower-body support unit 40 can be employed in common. By the same token, the width of the lower-body first support section 41, the width of the lower-body second support section 42, and the width of the lower-body third support section 43, rather than being made the same, may equally well differ. This is because varying the width of the lower-body first support section 41, the width of the lower-body second support section 42, and the width of the lower-body third support section 43 makes it possible that the movements of the different muscles can be further activated, and also because there can be instances where from the demands of design it is better that the widths be altered.

Meanwhile, given that the human body (skeleton and muscles) is fundamentally mirror-symmetrical, the lower-body first support section 41, the lower-body second support section 42, and the lower-body third support section 43 are respectively arranged in a mirror-symmetrical form. In reality, however, the roles of the muscles on the right side and the left side can be different (for example, in a right-footed person, the muscles for kicking, etc. with the right foot are developed), and in that respect, there are instances where it is preferable to dispose, in line with each individual, the support sections bilaterally asymmetrically, following the stream of the muscles on the right side and the left side. In addition, when for reasons such as the demands of design—as opposed to right—left differences (subtle differences in each individual) in location of the muscles—it is desired to render the support sections in a disposition that is not bilaterally symmetrical, making changes within the range in which the lower-body support unit 40 in the present embodying mode exhibits its functionality is possible. Further, for a lower-body support unit 40 in the present embodying mode, it is preferable to render the lower-body support unit 40 with the end portions being at either side (the origin area or the terminal area) of the corresponding muscles; but in cases where, given the demands of design and like reasons, altering its form is desired, making changes within the range in which the lower-body support unit 40 in the present embodying mode exhibits its functionality is possible.

Figure 14:
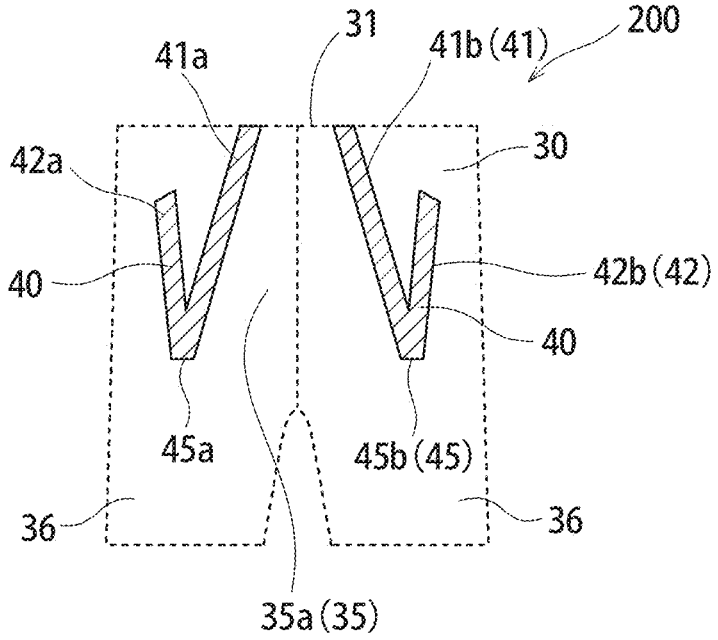
FIG. 14 is a front-side view illustrating supporting areas in the pants 200 involving the present-invention embodying mode.
Figure 15:
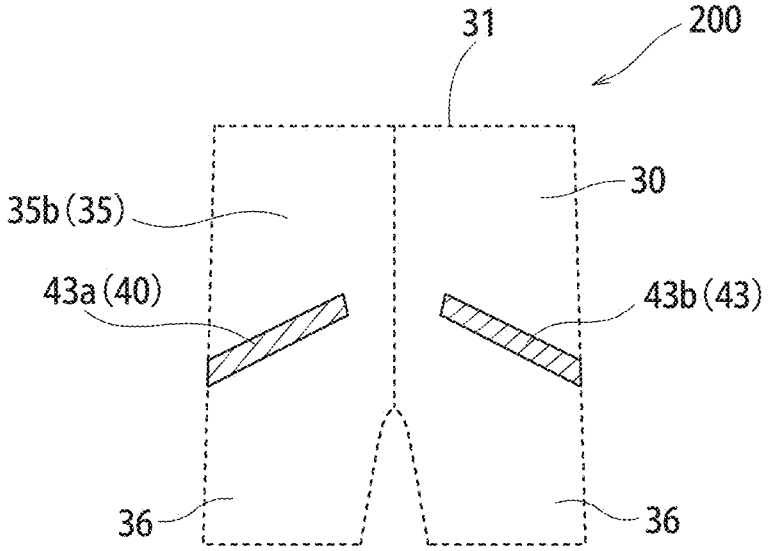
FIG. 15 is a rear-side view illustrating supporting areas in the pants 200 involving the present-invention embodying mode.

FIG. 14 and FIG. 15 are a front-side view and a rear-side view illustrating supporting areas in the trousers 200 involving the present embodying mode. Within the figures, the diagonally hatched areas correspond to the supporting areas. Specifically, the supporting areas (diagonally hatched areas) correspond to the lower-body first support section 41 (the psoas major muscles 901), the lower-body second support section 42 (the iliacus muscles 902), and the lower-body third support section 43 (the supraspinatus muscles 905). In the explanation set forth above, the lower-body support unit 40 (41, 42, and 43) was constructed from a taping medium but is not limited to that, as long as regions that are the supporting areas as illustrated in FIG. 14 and FIG. 15 may be created. For example, the supporting-area regions can be created by altering the substance and the weave of the lower-body piece 30 constituting the trousers 200. In such implementations, the lower-body support unit 40 of the present embodying mode can be constituted integrally with the material constituting the lower-body piece 30. Also, the materials and components with which the supporting areas can be made may otherwise be arranged in the interior of the material constituting the lower-body piece 30. Alternatively, clothing (trousers) 200 of the present embodying mode may be manufactured by forming storing sections such as pockets or the like in sites corresponding to the supporting areas (in sites on the obverse face, in the interior, or on the reverse face of the lower-body piece 30), and in those storing sections inserting items that may demonstrate a force that is supporting (a support force, or force that imparts the feel of being rested upon by tape or cloth). In addition, as long as supporting areas are formed in the manner illustrated in the drawings, supporting areas further may equally as well be formed in other locations. And the instance of creating the supporting areas by applying taping media can make not just pants for sports (shorts for soccer, shorts for tennis, golf pants, etc.), but also pants such as suit pants (slacks) and denim trousers (jeans) demonstrate the same beneficial effects.

Figure 16:
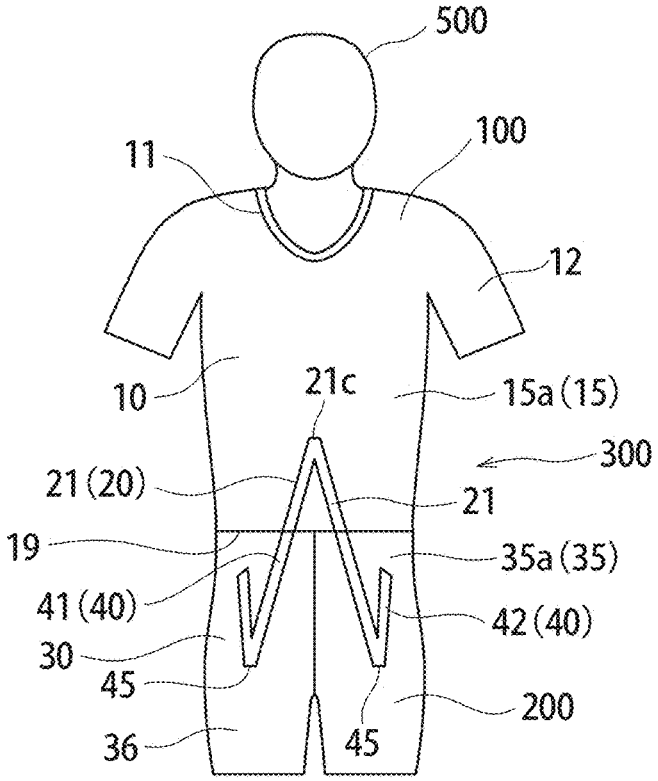
FIG. 16 is a front-side view illustrating a configuration, involving a mode of embodying the present invention, in which a shirt 100 and pants 200 are combined.
Figure 17:
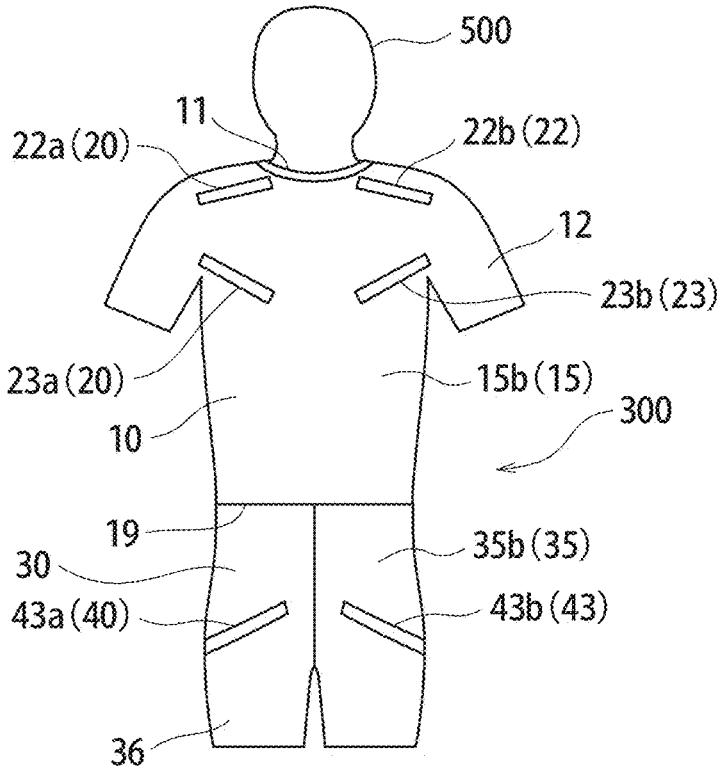
FIG. 17 is a rear-side view illustrating a configuration, involving the present-invention embodying mode, in which the shirt 100 and the pants 200 are combined.

Next, referring to FIG. 16 and FIG. 17, an explanation will be made of a configuration in which a shirt 100 and pants 200 involving the present embodying mode are combined. FIG. 16 and FIG. 17 are a front-side view and a rear-side view illustrating a configuration, involving a mode of embodying the present invention, in which a shirt 100 and pants 200 are combined. The user (wearer) 500 is wearing a top/bottom set of clothing 300—namely, is wearing both the shirt 100 and the pants 200.

As indicated in FIG. 16 and FIG. 17, combining the shirt 100 and pants 200 (top/bottom clothing) involving the present embodying mode makes possible the creation of supporting areas with respect to, as indicated in FIGS. 3(*a*) and (*c*), sites following the psoas major muscles 901, sites following the iliacus muscles 902, sites following the supraspinatus muscles 903, sites following the teres major muscles 904, and sites following the piriformis muscles 905. In particular, as indicated in FIG. 16, the upper-body first support section 21 and the lower-body first support section 41 are combined, wherein as a result supporting areas can be created by the taping media (or other means) in sites following the psoas major muscles 901 (zones spanning their entire range).

Figure 18:
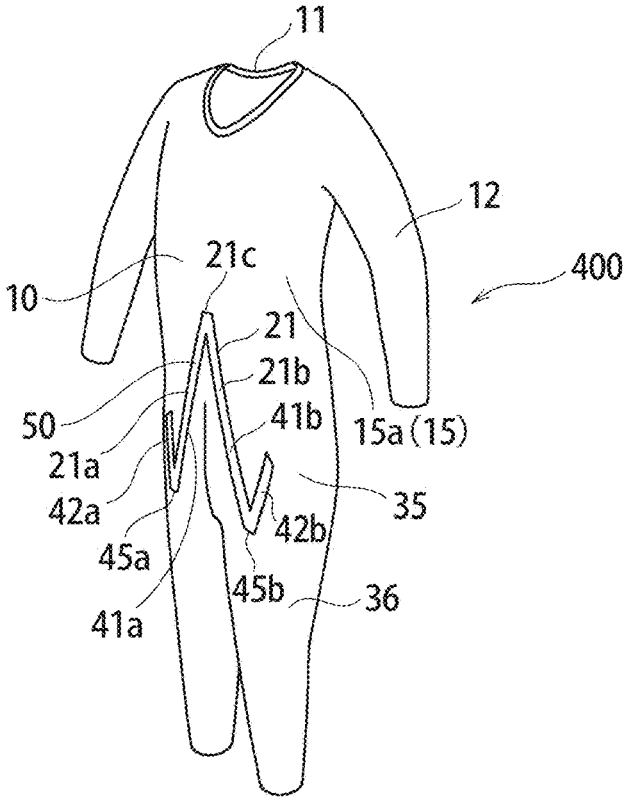
FIG. 18 is a perspective view illustrating the front-side configuration of clothing (a skinsuit) 400 involving a mode of embodying the present invention.
Figure 19:
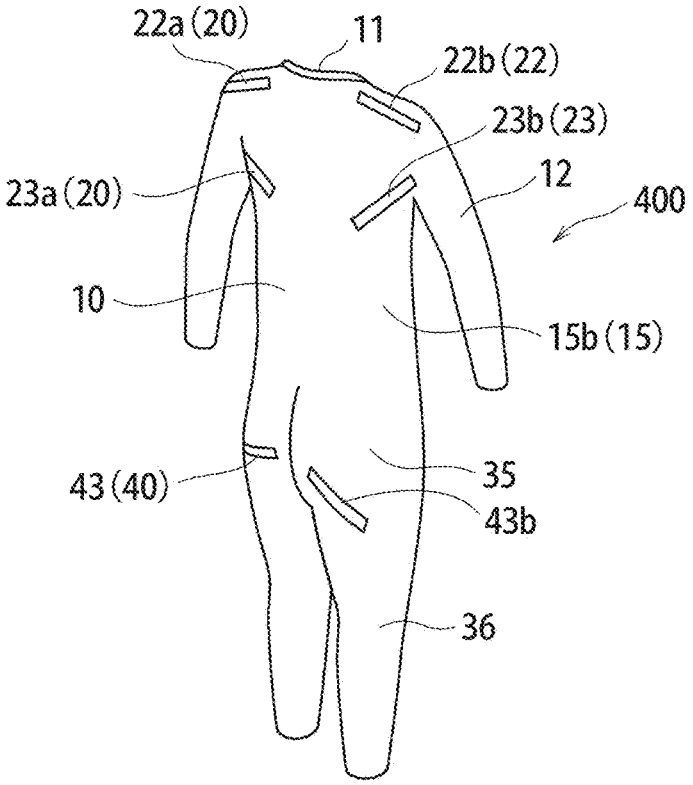
FIG. 19 is a perspective view illustrating the rear-side configuration of the clothing (skinsuit) 400 involving the present-invention embodying mode.

Further, the mode may be not only combining the shirt 100 and pants 200 (top/bottom clothing) involving the present embodying mode, but also a skinsuit in which the top/bottom clothing is made unitary. FIG. 18 and FIG. 19 respectively illustrate the front-side configuration and the rear-side configuration of clothing (a skinsuit) 400 involving a present embodying mode.

In a skinsuit 400 involving the present embodying mode, the upper-body piece 10 includes the lower-body piece (30) to take on a unitary configuration (top/bottom clothing main-body section). In order to make it easier to put on and take off the skinsuit 400, in a portion thereof (the back etc.), buttons, a zipper, or the like may be provided. The skinsuit 400 is tantamount to coveralls for construction venues and coveralls for work (e.g., automotive servicing etc.) in workshops, as well as to full-body tights, wet suits used for surfing or scuba diving, and swimsuits, etc.

Figure 20:
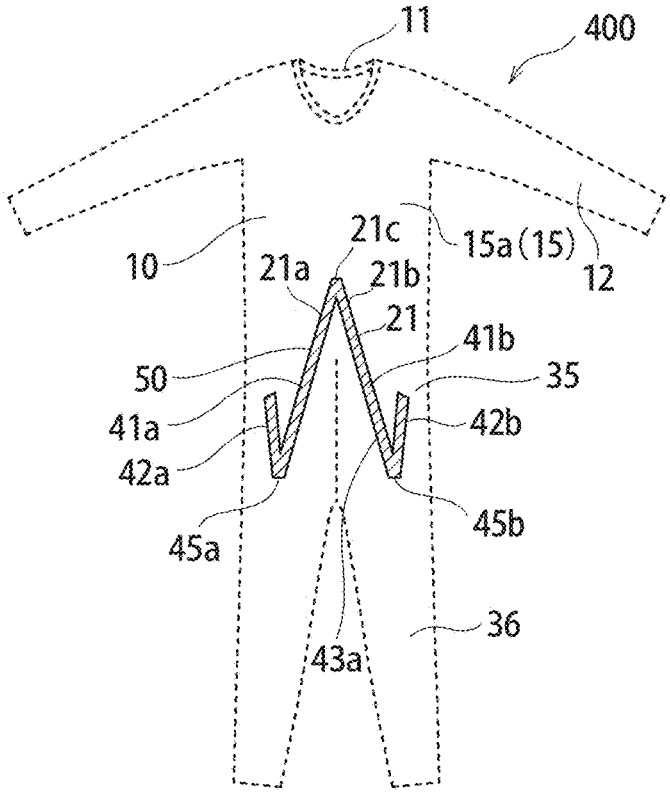
FIG. 20 is a front-side view illustrating supporting areas in the skinsuit 400 involving the present-invention embodying mode.
Figure 21:
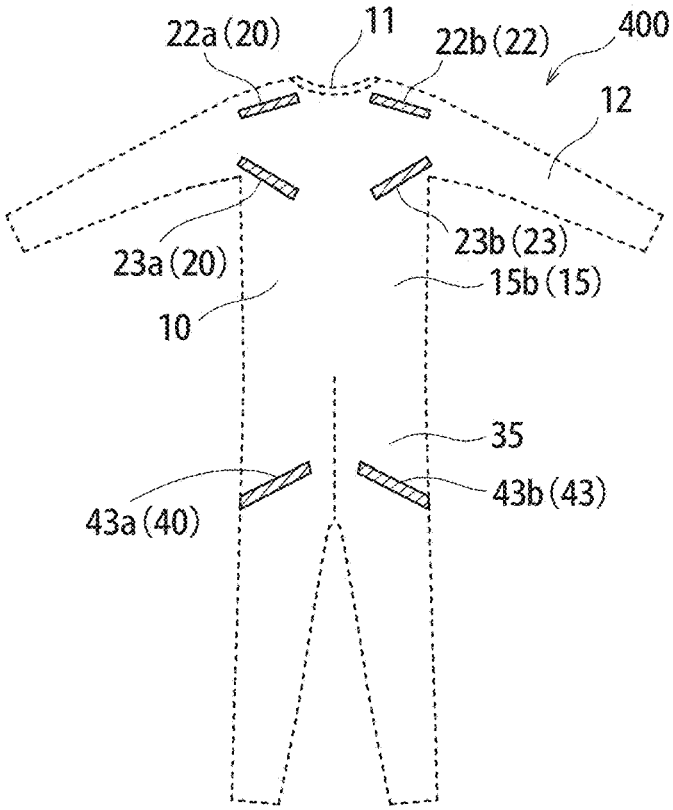
FIG. 21 is a rear-side view illustrating supporting areas in the skinsuit 400 involving the present-invention embodying mode.

FIG. 20 and FIG. 21 are a front-side view and a rear-side view illustrating supporting areas in the skinsuit 400 involving the present embodying mode. Within the figures, the diagonally hatched areas correspond to the supporting areas. Since the details overlap what has been described above, for the sake of brevity a description thereof will be omitted; meanwhile, details such as that a continuous support unit 50 (upper-body support unit 20 and lower-body support unit 40) in which the upper-body first support section 21 and the lower-body first support section 41 are combined may be constructed from tape media, and that supporting-area regions can be created by altering the clothing substance and weave are as described above.

Figure 22:
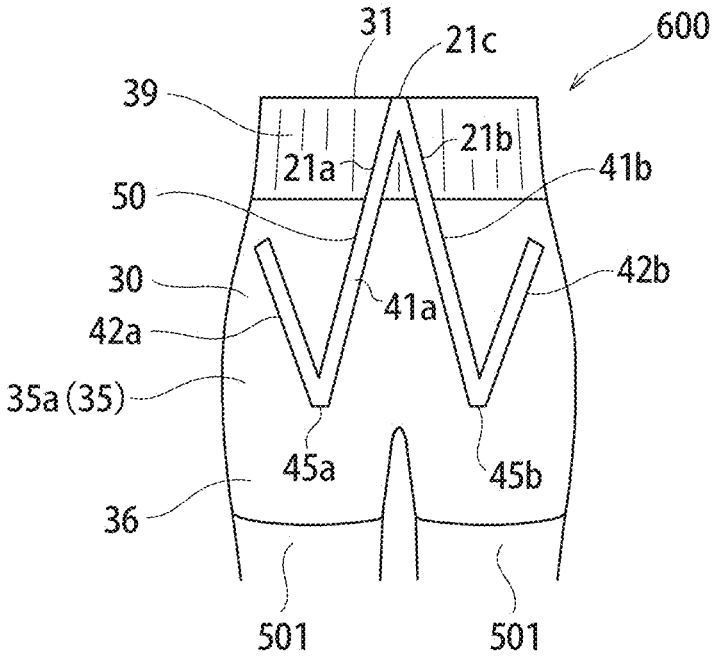
FIG. 22 is a front-side view illustrating the configuration of clothing (briefs) 600 involving a mode of embodying the present invention.
Figure 23:
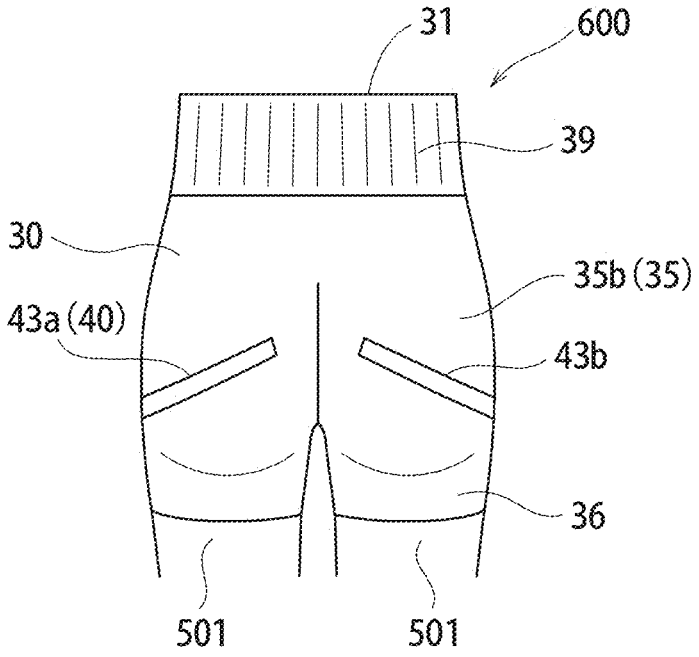
FIG. 23 is a rear-side view illustrating the configuration of the clothing (briefs) 600 involving the present-invention embodying mode.

Referring now to FIG. 22 and FIG. 23, an explanation will be made of the configuration of pants (briefs) 600 involving a present embodying mode. FIG. 22 and FIG. 23 are a front-side view and a rear-side view illustrating the configuration of briefs 600 involving the present embodying mode.

In the briefs 600 involving the present embodying mode, along the upper end 31 of the lower-body piece 30, a waistband 39 (elastic section) is provided. Therein, as illustrated in FIG. 22, a continuous support unit 50 is formed in the briefs 600, in which an upper-body first support section 21, a lower-body first support section 41, and a lower-body second support section 42 of the above-described embodying modes are combined. Also, as illustrated in FIG. 23, at the upper ends of the wearer's legs 501 (nearby the buttocks), a lower-body third support section 43 (43*a* and 43*b*) is formed situated in sites following the piriformis muscles 905. According to experiments by the inventors in the present application, an effect was established where in test subjects who wore the briefs 600 of the present embodying mode for three weeks, their waist size decreased naturally (there was a test subject who experienced a dieting effect of a 10-cm reduction in waist size).

Figure 24:
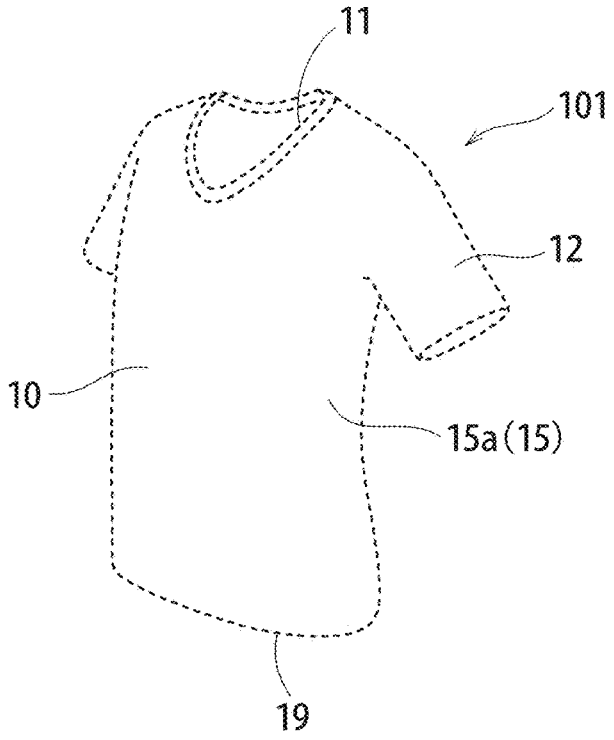
FIG. 24 is a perspective view illustrating the front-side configuration of clothing (a shirt) 101 involving a mode of embodying the present invention.
Figure 25:
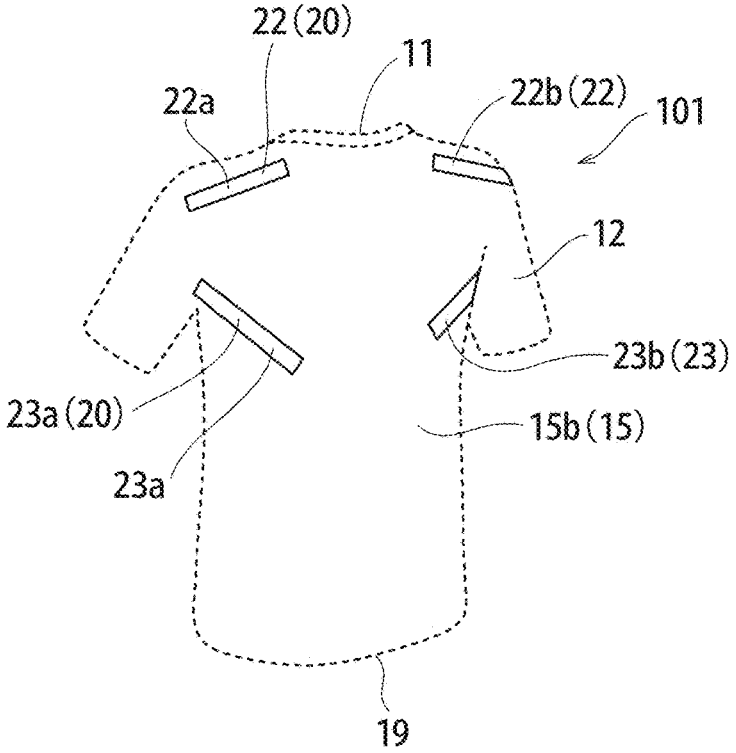
FIG. 25 is a perspective view illustrating the rear-side configuration of the clothing (shirt) 101 involving the present-invention embodying mode.

An implementation utilizing the briefs 600 of the present embodying mode can be combined with the shirt 101 illustrated in FIG. 24 and FIG. 25. FIG. 24 and FIG. 25 are perspective views illustrating, respectively, the front-side configuration and the rear-side configuration of clothing (the shirt) 101 involving a mode of embodying the present invention. The upper-body first support section 21 situated in sites, along the shirt 100 illustrated in FIG. 8, following portions of the psoas major muscles (901) is not formed on the shirt 101 involving the present embodying mode. The rest of the configuration of the shirt 101 involving the present embodying mode is similar to that of the shirt 100 illustrated in FIG. 8. Although the shirt 101 illustrated in FIG. 24 lacks the upper-body first support section 21, a section that corresponds to it is formed on the briefs 600 illustrated in FIG. 22, so that combining the two forms complementary articles.

Here, experiments by the inventors in the present application established that lower-body movement in those who wore pants (200 or 600) of the present embodying mode was stabilized, and that even if pants (200 or 600) of the present embodying mode are not worn, capacity for movement improved during exercise in which the shirt 101 illustrated in FIG. 24 and FIG. 25 was worn. This is inferred to originate in that given that the upper-body second support section 22 situated in sites following the supraspinatus muscles (903), and the upper-body third support section 23 situated in sites following the teres major muscles (904) are formed on the shirt 101 of the present embodying mode, these muscles (903 and 904) are activated by their being supported, so that the natural, Conception-Vessel, and Governing-Vessel meridians can be made to flow spontaneously. It should be noted that where the shirt 100 and the shirt 101 of the present embodying modes are compared, the shirt 100, being better balanced, is preferred (for example, in some cases such differences as post-exercise fatigue occurring less appear.)

Embodiment Examples

Next, referring to FIG. 26 through FIG. 28 and FIG. 29 through FIG. 31, an explanation of embodiment examples (experimental examples and comparative examples) utilizing clothing involving modes of embodying the present invention will be made.

FIG. 26 is a table presenting results prior to having test subjects wear (comparative examples: "before"), and after having them wear (embodiment examples: "after"), a shirt 101 of the present embodying mode (what is represented in FIG. 24 and FIG. 25). The test subjects were seventeen individuals: No. 1 through No. 17. A shirt 101 of the present embodying mode, in which a taping medium was applied to the reverse side of an ordinary T-shirt, was manufactured, and that was utilized as the embodiment examples. The width of the tape employed was 25 mm. Specifically, a product with the name "Black Silica Knee Supporter" (manufactured by Holon KK; quality-assurance-label materials: cotton, nylon, and polyurethane) was cut into tape strips to make it into a taping medium, and this was bonded to the predetermined locations.

Under "Single-Leg Stance" in FIG. 26, the number of seconds that standing on one leg was possible is entered, which was measured with 60 seconds being the limit.

Under "Forward Bend," angles during a standing forward bend (and the before—after change) are presented. For "Forward Bend," rather than being measured by hand, in order to secure objectivity the angles are in a posture-analysis report from images shot and analyzed with a posture-analysis app produced by SysNavia KK (a smartphone app for Android)). One example of the posture-analysis reports (for test-subject No. 13) is presented in FIG. 27. In FIG. 27, (*e*-1) is the "before wearing" (comparative example) forward-bend result, and (*e*-2) is the "after wearing" (embodiment example) forward-bend result. Similarly, here (*a*-1) through (*d*-1) are "before wearing" (comparative example) results, while (*a*-2) through (*d*-2) are "after wearing" (embodiment example) results. Since the forward-bend results are easily understood because they explain flexibility, they are presented in the FIG. 26 table, yet with the other items (*a*-2) through (*d*-2) as well, where the axis became upright the results can be interpreted as flexibility having improved.

Under "Arm Wrestling" in FIG. 26, persons of about the same physique and arm strength were paired, and results being at how many seconds did one of them win (before/after) are presented. "Aiki-Age" is a test of the action of a test subject's lifting upward both his or her hands being held down in a state in which both hands of the test subject are pressed down by a partner with both of his or her hands. A was-not-able-to-lift result is "x," while lifted-after-sometime is "Δ." Was-able-to-lift-immediately is "○." The criterion for "○" was within 5 seconds, and for "Δ," 10 to 20 seconds. The other items also basically follow these criteria.

"Rise" is a test of the action of a test subject's standing in a held-down state in which the shoulders of the test subject, seated in a chair, are being pressed down. A was-not-able-to-get-up result is "x." "Arm-Twist" is a test of the action of a test subject's returning his or her arm from a twisted state in which a partner is twisting it. "Nursing Care" is an action (count of seconds) in which the test subject raises up a volunteer who is lying down. Not being able to raise the person up is "x."

In FIG. 26, "Activeness Level," "Stableness Level," "Pleasantness Level," and "Alertness Level" are items whose indices (two-dimensional gauges of feeling) cannot be captured in numeric figures as to improvement in capacity for movement. These "two-dimensional feeling gauges" are according to the paper, "Psychological Effects That Wearing Compression Garments for Sports Exert" in *Hosei University Physical Education & Sports Center Proceedings*, Tadashi Nakazawa et al., Vol. 30, pp. 29-34 (2012). A questionnaire (in item-scoring form) for the two-dimensional feeling gauges is presented in FIG. 28.

In the experimental results set forth in FIG. 26, from "Single-Leg Stance" it is seen that the numeric values (second counts) for test subject No. 5 and test subject No. 13 showed significant improvement. (The other test subjects were mostly able to keep the single-leg stance going from the beginning.) It should be noted that the numeric value for test subject No. 11 sunk significantly, but this was that the person ended up laughing and could not stand, such that essentially the value is one to be omitted from the table; despite its having been entered as an experimental result, it may be ignored.

In "Forward Bend" presented in FIG. 26, the before—after change improved an average 5.5°, establishing that dressing in a shirt 101 of the present embodying mode improved flexibility. For No. 13, merely from being dressed in the shirt, the forward-bend numbers improved 17°; the subject's flexibility rose pronouncedly. This also may be discerned clearly from comparing (*e*-1) and (*e*-2) in FIG. 27. Not from exercise, massage, stretching, etc., but simply from wearing a shirt 101 of the present embodiment example, the difference was remarkable.

In "Arm Wrestling" set forth in FIG. 26, the before—after change also improved—an average 6.3 seconds. With "Rise" as well, the before—after change improved—an average 1.6 seconds. And with "Arm Twist," the before—after change in subjects who were successful increased.

In "Nursing Care" also, the before—after change improved—an average 6.6 seconds. It should be noted that for Nursing Care test subjects No. 5 and No. 16, because with the shirt 101, the volunteer was not raised, he/she was dressed in trousers 200, enabling him/her to be raised, and on that account, the "Δ" mark is entered in the table.

In this way, just looking at the averages for the seventeen test subjects indicates that improvement in capacity for movement was clearly established. What is more, when not just the average numbers but the individual test subjects are looked at, volunteers who improved remarkably are found here and there.

From the respective results (two-dimensional feeling gauges) for "Activeness Level," "Stableness Level," "Pleasantness Level," and "Alertness Level" in FIG. 26 as well, it will be seen that on average, activeness level went up 4.1 points, stableness level went up 3.2 points, pleasantness level went up 6.9 points, and alertness level went up 1.2 points, wherein with all the items the scores improved. Accordingly, with the two-dimensional feeling gauges as well, the effectiveness of the shirt 101 of the present embodiment example was confirmed.

Next, FIG. 29(*a*) through (*c*) set forth the results of experiments for improvement in actions during tennis. Where the number of the test subject is the same (e.g., No. 21), the person is identical. In the experiments, tests were carried out with sportswear (tennis wear) onto which taping media (therapeutic tape of 50 mm width) were applied in the given sites represented in FIG. 3 for the muscles 901 through 905, to render the sportswear in the condition of the clothes 300 illustrated in FIG. 16 and FIG. 17.

FIG. 29 (*a*) presents results for the forehand; FIG. 29(*b*), results for the backhand; and FIG. 29(*c*), results for the serve. "Comparison" is results in which ordinary sportswear was worn, while "Dressed" is where, in the experiments, tests were carried out with the sportswear onto which taping media (therapeutic tape of 50 mm width) were applied in the given sites represented in FIG. 3 for the muscles 901 through 905, to render the sportswear in the condition of the clothes 300 illustrated in FIG. 16 and FIG. 17. In FIG. 29(*a*) through (*c*), where (the cells where) the results were particularly good, they are shown highlighted.

As to the results for the forehand in FIG. 29 (*a*), in terms of the average values, although the ball spin was almost the same, in that the swing speed had a change percentage of 103.3 (105.6 km→108.9 km) while the ball speed had a change of 106 (104.1 km→110 km), the ball speed went up by approximately 6 km. To raise ball speed 6 km, fitness training is necessary, as is bettering one's form, yet these results are remarkable in that they are only from wearing a shirt 100 of the present embodying mode. Especially if the wearer were at the level of top amateur or professional player, the advantages of raising ball speed simply from wearing a shirt 100 (or depending on the case, pants 200) would be immeasurable. In particular, such an increase in speed makes the difference as to whether a player who may be at the professional level can become a top-level pro; while in a separate sport, baseball, the increase ties in with the distinction as to whether a player who may be at the draft-candidate level can turn pro in the draft, and if it is in professional baseball, the increase ties in greatly with the distinction as to whether a player can become a top-level pro.

As to the results for the backhand in FIG. 29(*b*), also looked at with the average values, both the swing speed, with a 103.7 (85.3 km→km) change percentage, and the ball speed, with a 104.5 (92.4 km→96.5 km) change percentage, went up.

As to the results for the serve in FIG. 29(*c*), while there was no large change, this was inferred to be because, owing to the necessity that the serve enter the opponent's court, though flexibility and capacity for movement improved, it would unlikely be reflected in the numeric figures.

Figure 30A:
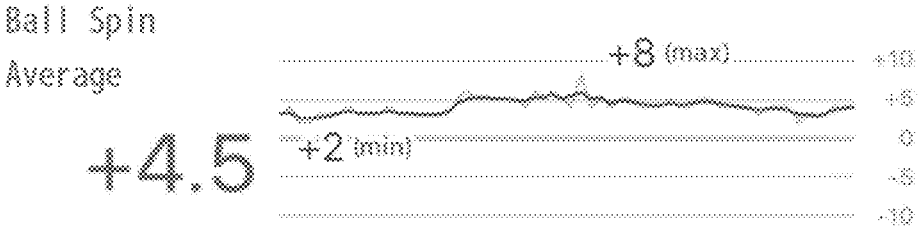
FIGS. 30 (*a*), 30 (*b*) and 30 (*c*) are graphs plotting experimental results in the comparison examples.
Figure 30B:
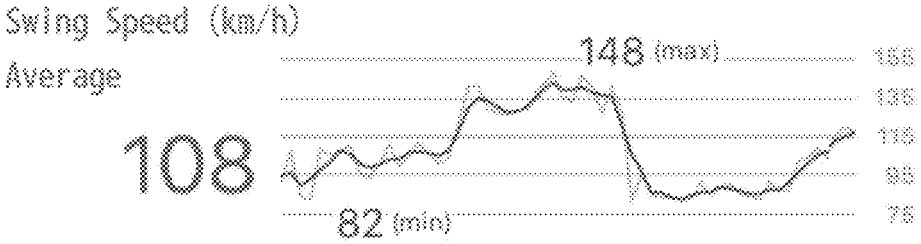
Figure 30C:
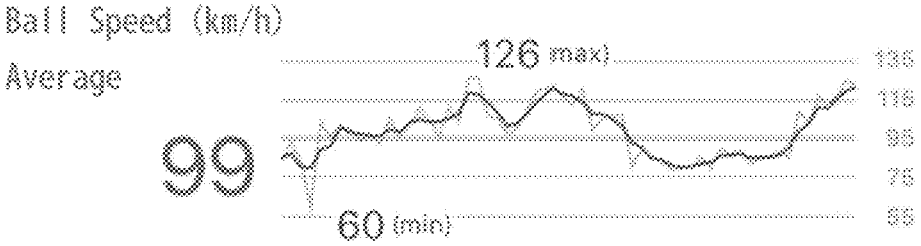
Figure 31A:
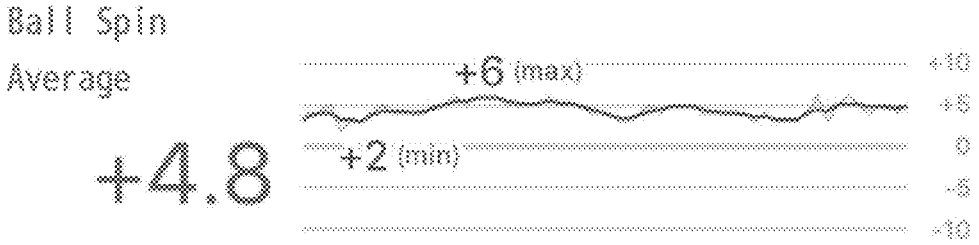
FIGS. 31 (*a*), 31 (*b*) and 31 (*c*) are graphs plotting experimental results in the embodiment examples.
Figure 31B:
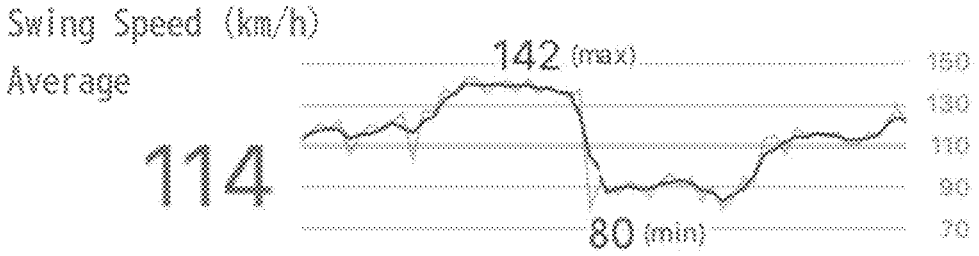
Figure 31C:
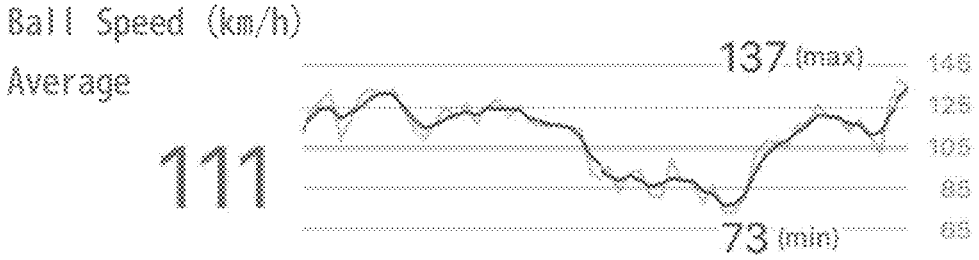

FIG. 30 and FIG. 31 are respective results (average values of four player's forehand strokes) in tennis played before wearing and after wearing a shirt 100 and pants 200 of the present embodying modes. Specifically, the results graphed in FIG. 31 are from tests that were carried out with the sportswear of the tennis played in the FIG. 30 results, onto which taping media (therapeutic tape of 50 mm width) was applied in the given sites represented in FIG. 3 for the muscles 901 through 905, to render the sportswear in the condition of the clothes 300 illustrated in FIG. 16 and FIG. 17. In both figures, (*a*) plots ball spin; (*b*), swing speed, and (*c*), ball speed. The measurements were performed employing a "Smart Tennis Sensor" manufactured by Sony Corp. The same is true with the test results in FIG. 29.

As is understood from looking at both sets (comparative examples and experimental examples) of graphs, the ball revolutions went up from +4.5 (noting that slices are negative numbers) to +4.8; the swing speed went up from 108 km to 114 km; and the ball speed went up from 99 km to 111 km. With all the items remarkable effectiveness was confirmed. Especially, just wearing the clothing (100 and 200) of the present embodying modes threatens to elevate ball speeds by 10 km or more. What is more, in this experiment, for the player in whom the number-one change in ball speed showed, it was 98 km→124 km (127%).

In the foregoing, configurations and embodiment examples of the present embodying modes have been described. As may be understood from the foregoing explanation, according to clothing (a shirt) 100 of the present embodying modes, on an upper-body piece 10 for covering at least a portion of the upper half of the body, an upper-body support unit 20 is formed, and the upper-body support unit 20 includes an upper-body first support section 21 situated in sites following at least a portion of the psoas major muscles (901), an upper-body second support section 22 situated in sites following the supraspinatus muscles (903), and an upper-body third support section 23 situated in sites following the teres major muscles (904), thereby activating the muscles by their being supported, so that the natural, Conception-Vessel, and Governing-Vessel meridians can be made to flow spontaneously. As a result, the wearer's muscles (or otherwise, entire body, including the muscles and joints, etc.) are supported in situations such as during sports, during heavy lifting, or being under nursing care, making improved capacity for and flexibility in movement possible.

In addition, according to clothing (trousers) 200 of the present embodying modes, by combining with clothing (lower-body clothes) in which on a lower-body piece 30 for covering at least a portion of the lower half of the body, a lower-body support unit 40 is formed—with the lower-body support unit 40 including a lower-body first support section 41 situated in sites following at least a portion of the psoas major muscles (901), a lower-body second support section 42 situated in sites following the iliacus muscles (902), and a lower-body third support section situated in sites following the piriformis muscles (905)—in the lower half of the body, in the same way as with the upper half of the body, the muscles are activated by their being supported, so that the natural, Conception-Vessel, and Governing-Vessel meridians can be made to flow spontaneously. What is more, the lower-body third support section situated in sites following the piriformis muscles facilitates maintaining one's up-and-down and front-and-back balance.

In the shirts 100 of the above-described embodying modes, the upper-body second support sections 22 (22*a*, 22*b*) are disposed extending slightly upward, as indicated in FIG. 9. This will be that way when the shirt 100 is made to be comparatively snug on the body, so as to go along the directions in which the supraspinatus muscles (903) extend, while with a shirt 100 that is slightly loose-fitting on the body (baggy), there will be instances where, with the upper-body second support sections 22 (22*a*, 22*b*) being arranged on the shirt 100 so as to follow along the supraspinatus muscles (903), when the shirt 100 is taken off, the arrangement (extension) of the upper-body second support sections 22 (22*a*, 22*b*) will differ slightly from what is indicated in FIG. 9. Likewise, as indicated in FIG. 4(*a*), since the supraspinatus muscles (903) have width, depending on which striae the upper-body second support sections 22 (22*a*, 22*b*) are disposed over within the range over which the supraspinatus muscles (903) run parallel, the arrangement of the upper-body second support sections 22 (22*a*, 22*b*) in some cases will be altered compared with what is depicted in FIG. 9. This is the same for the upper-body third support sections 23 (23*a*, 23*b*)—namely, since the teres major muscles (904) too have width, also depending on which striae the upper-body third support sections 23 (23*a*, 23*b*) are disposed over—there will be instances where the arrangement (extension) of the upper-body third support sections 23 (23*a*, 23*b*) will differ slightly from what is indicated in FIG. 9.

Figure 32:
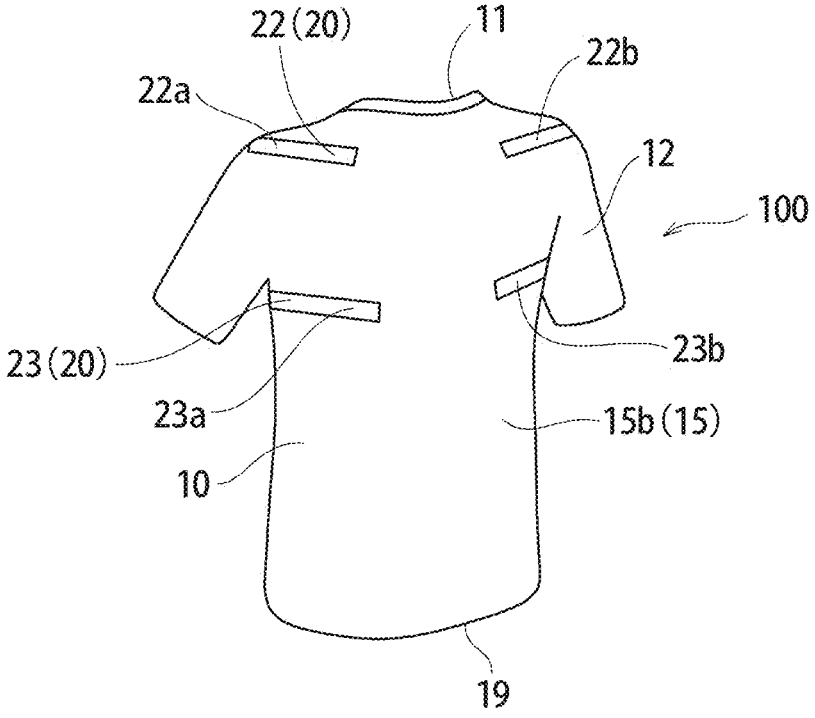
FIG. 32 is a perspective view illustrating the rear-side configuration of clothing (a shirt) 100 involving a mode of embodying the present invention.
Figure 33:
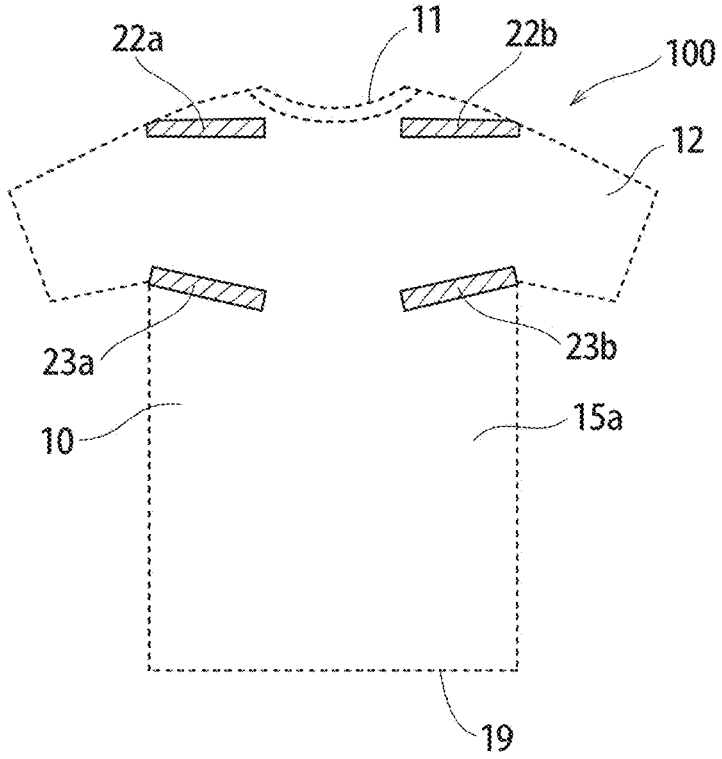
FIG. 33 is a rear-side view illustrating supporting areas in the shirt 100 involving the present-invention embodying mode.

FIGS. 32 and 33 are one example of a shirt 100 of a present embodying mode, and correspond to the above-described embodying mode of FIG. 9 and FIG. 11, respectively. In the illustrated shirt 100, the upper-body second support sections 22 (22*a*, 22*b*) extend more or less in parallel, while the upper-body third support sections 23 (23*a*, 23*b*) extend downwardly a bit. If the shirt 100 is made roomier, or in like situations, there will be instances where the upper-body second support sections 22 (22*a*, 22*b*) extend downwardly a bit when the shirt 100 has been taken off and made flat. Also, if the shirt 100 is made roomier, or in like situations, there will be occasions where the upper-body third support sections 23 (23*a*, 23*b*) extend more or less in parallel (or in some cases, extend upwardly somewhat). With these arrangements, after the dispositions of the upper-body second support sections 22 (22*a*, 22*b*) and the upper-body third support sections 23 (23*a*, 23*b*) are determined in patterns following the supraspinatus muscles (903) and the teres major muscles (904), they will assume the configuration example as illustrated in FIG. 32 and FIG. 33, when the upper-body second support sections 22 and upper-body third support sections 23 are viewed in terms of the configuration of the shirt 100 unitarily. It should be noted that with the shirts (100, 101, 102) of the present embodying modes, in instances where the support sections (21, 22, 23) are arranged on the inner side of the shirt body, comparatively looser shirts, due to the contact stimulation, will tend to more readily bring out the effectiveness of the present embodying modes.

Figure 34:
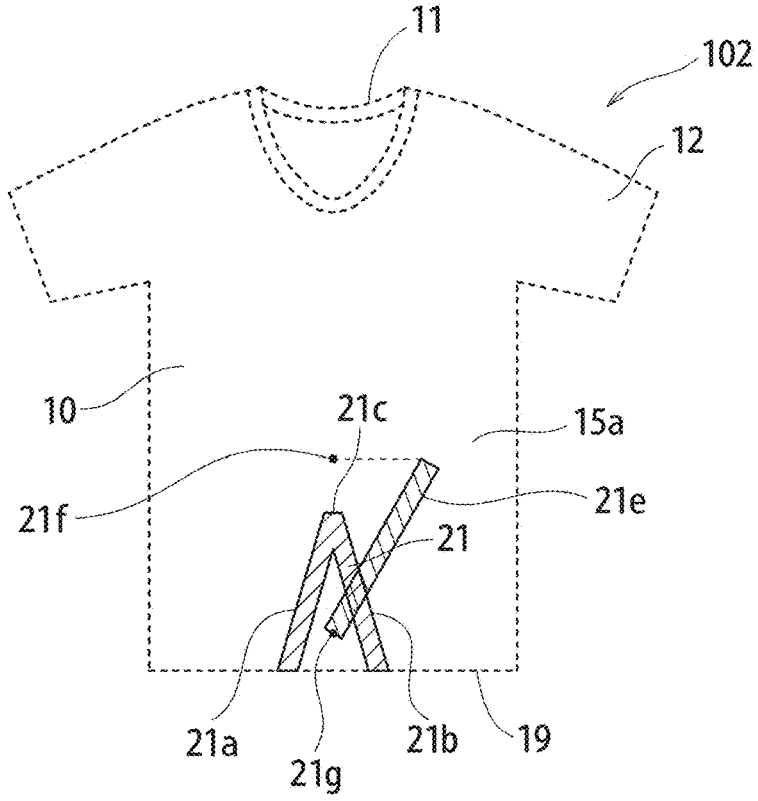
FIG. 34 is a front-side view illustrating supporting areas in a shirt 102 involving a mode of embodying the present invention.

FIG. 34 illustrates a modified example of a shirt 102 involving a present embodying mode. FIG. 34 corresponds to the above-described embodying mode of FIG. 10, while the back-side configuration of the shirt 102 in the present embodying mode is that illustrated in FIG. 11 as well as FIG. 33.

In the shirt 102 illustrated in FIG. 34, in addition to the upper-body first support sections 21 (21*a*, 21*b*), an additional upper-body support section 21*e* (or an upper-body fourth support section) is formed. The additional upper-body support section 21*e* (upper-body fourth support section) is disposed extending from a starting point to an infraumbilical site (21*g*), where a point shifted toward a location on the left ribs, with the site of the solar plexus (21*f*) as a reference, is taken as the starting point. By and large, the solar plexus (21*g*) is in a spot about three fingers below the navel. The angle at which the additional upper-body support section 21*e* extends (the angle of its inclined extension) is, with a perpendicular line as a reference, 20° to 25° (in one example, approximately 23° (23.4°).

Forming the additional upper-body support section 21*e* (upper-body fourth support section) enlarges the body's rotation. Compared with the situation where a shirt 102 of the present embodying mode is not being worn (comparative example), when a shirt 102 of the present embodying mode is being worn, the body's rotation along the horizontal increases by 10 to 20° both left and right (adding the respective left—right angles of increase, the gain is 20° to 40°). This increase angle is the average value for a plurality of test subjects. Forming of the upper-body support section 21*e* (upper-body fourth support section) increases the angle of rotation along the horizontal and is therefore suited to playing golf. It will be appreciated that since the amount of rotation increases when a shirt 102 of the present embodying mode is utilized in golf, in order to stabilize the lower body, dressing in trousers 200 of the present embodying modes is preferable.

FIG. 35 presents test results for golf result when shirts 102 and trousers 200 of the present embodying modes were worn. The test was carried out by six test-subject volunteers (No. 31 to No. 36). The comparative examples are results in which the volunteers performed golf swings without being dressed in shirts 102 and trousers 200, and meanwhile, the embodiment examples are results in which they performed golf swings while being dressed in shirts 102 and trousers 200. The test location was a golf practice range, and the clubs used were irons. Flight distances and left/right fade were measured by sight, wherein "Left 10" in the figure (in the table) expresses a bending of 10 meters to the left. Also, under "Remarks" the test subject's thoughts/feelings are noted.

For all six test subjects (No. 31 to No. 36) flight distances extended. Therein, with the experimental results (and the test subject's thoughts/feelings), it was found that on top of the increase in flight distance from sped-up swings, the effects from the lessening of left/right fade that stabilized swings and shots was significant as well. What is more, there were a number of thoughts/feelings ("tension disappears," "hitting lightly," "have heft") saying that the subjects got rid of tension in the swing, allowing them to take relaxed shots. Still further, looking not only at the thoughts/feelings of the test subjects, but also the experimental results, shows that the proportion of "Center" shots in the embodiment examples increased compared with the comparative examples.

Being dressed in a shirt 102 (and trousers 200 for lower-body stability) of the present embodying modes can, in addition to the effects of a shirt 100 (FIG. 10, etc.) of the above-described embodying modes, make the body's rotation angle along the horizontal (the angle through which the shoulders turn) greater. In other words, forming the additional upper-body support section 21*e* (upper-body fourth support section) enlarges the body's rotation, and makes improving swing (e.g., golf swing) capability possible.

Figure 36:
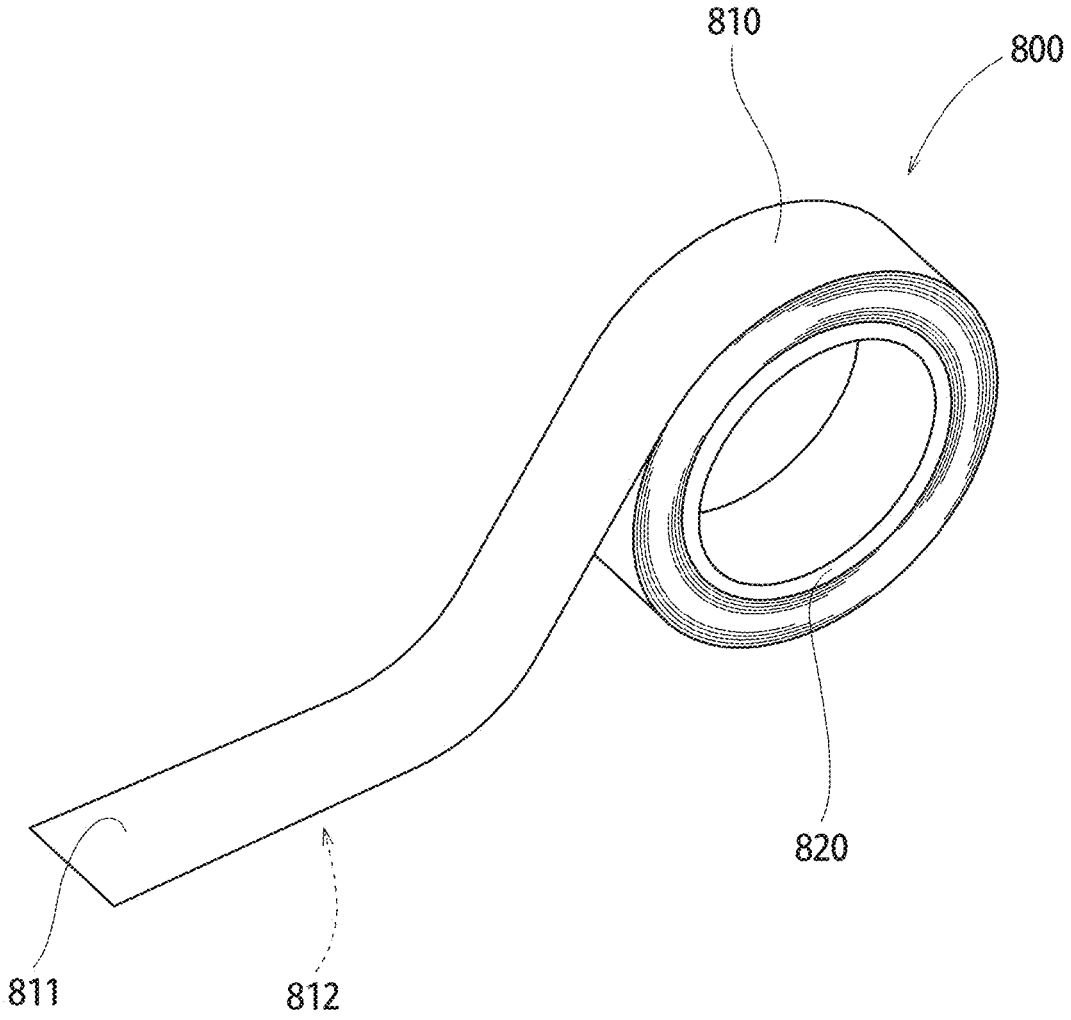
FIG. 36 is a perspective view schematically illustrating the configuration of a tape product 800 involving a mode of embodying the present invention.

In clothing 100 (101, 102, 200, 300, 400, 600, etc.) of the present embodying modes, when tape (cloth tape) having a heat-activated adhesive is utilized as the taping medium, a tape product 800 as illustrated in FIG. 36 can be employed. The tape product 800 is constituted from a cloth part (tape part) 810, and a core part (wind-on center part) 820 around which it is wound. The cloth part (tape part) 810 of the present embodying mode is cotton (e.g., interlock cotton 40), but may be another cloth material (or tape material). The width of the cloth part (tape part) 810 is from 10 mm to 30 mm (in this example, 20 mm±5 mm). The cloth material (e.g., cotton) is exposed on a first surface (obverse face) 811 of the cloth part (tape part) 810, and a heat-activated adhesive is coated onto a second face (reverse face) 812 thereof. The heat-activated adhesive is a substance that becomes an adhesive under an iron, adhering (bonding) by being subjected to approximately 15 to 20 seconds' heat with an (e.g., 140 to 160° C., dry) iron. The heat-activated adhesive is, for example, an aqueous silylated-urethane polymer adhesive, but is not particularly limited.

In the foregoing, preferred modes of embodying the present invention have been described, yet such descriptions are not limiting items, and of course, various modifications are possible. The above-described embodying modes as well as the configurations of modified examples as well as the techniques are mutually applicable. For example, with the configuration of a shirt 100 (101) of the present embodying modes, given the difficulties during nursing care with changing a patient's clothes or with the patient changing clothes, the configuration may be a mode in which the front is made to open by putting buttons or a zipper on the shirt. Although with regard to shirts, T-shirt modes were principally described, in golf, since collared shirts are basically required, it is preferable to configure the embodying modes as collared shirts. Further, since the lower-body third support section 43, situated in sites following the piriformis muscles 905, alleviates intensification of the feeling of being tugged at by an attractive force, in situations where there need not be concern about that odd sense, the lower-body third support section 43 can be taken off. Although the direct application of tape to the body is not to be denied, clothing (100, 101, 102, 200, 300, 400, 600, etc.) of the present embodying modes is more convenient. It should be noted that according to the inventors in the present application having made trials, compared with cases where clothing of the present embodying modes is worn, the effectiveness is reduced (for example, by half) in cases where direct taping is applied to the body. In addition, while in the above-described embodying modes, examples for sports (tennis, etc.) were amply illustrated, there are also advantages in situations apart from sports, in that during hauling work, heavy lifting is lightened (eased), and in that nursing care on the part of who is being nursed as well as on the part of who is nursing is made easier.

INDUSTRIAL UTILIZABILITY

According to the present invention, clothing that supports the wearer's muscles, joints, etc. to enable capacity for and flexibility in movement to be improved in situations such as during sports, during heavy lifting, or being under nursing care can be made available.

DESCRIPTION OF REFERENCE MARKS

10: upper-body piece
11: collar section
12: sleeve sections
15: trunk portion
15*a*: front waist
15*b*: rear waist
19: lower edge
20: upper-body support unit
21: upper-body first support section
21*e*: additional upper-body support section (upper-body fourth support section)
22: upper-body second support section
23: upper-body third support section
31: waist section
32: opening
35: above-crotch section
35*a*: front waist
35*b*: rear waist
36: below-crotch section
39: waistband
40: lower-body support unit
41: lower-body first support section
42: lower-body second support section
43: lower-body third support section
50: continuous support unit
100: shirt (T-shirt)
101: shirt
102: shirt
200: trousers (pants)

400: skinsuit
600: briefs
810: cloth part (tape part)
800: tape product
901: psoas major muscle
902: iliacus muscle
903: supraspinatus muscle
904: teres major muscle
905: piriformis muscle
1000: athletic wear

The invention claimed is:

1. Clothing for covering a body of a wearer, the clothing comprising:

a lower-body piece for covering at least a portion of a lower half of the body; and a lower-body support unit on a pelvic area of the lower-body piece, wherein the lower-body support unit includes a lower-body first support section and a lower-body second support section forming a V-shape, wherein the lower-body first support section extends from a medial top region of the lower-body piece downwardly and laterally to a vertex of the V-shape, and wherein the lower-body piece does not include a support unit below the vertex of the V-shape on a front side of the lower-body piece.

2. The clothing set forth in claim 1, wherein a width of the lower-body first support section, a width of the lower-body second support section, and a width of a lower-body third support section are each not greater than 50 mm.

3. The clothing set forth in claim 1, wherein the lower-body support unit comprises a taping medium affixed to at least the front side of the lower-body piece or a rear side of the lower-body piece.

4. The clothing set forth in claim 1, wherein the lower-body first support section extends from a top edge of the lower-body piece to the vertex of the V-shape, and wherein the lower-body second support section extends from the vertex of the V-shape to a point lower than the top edge of the lower-body piece and central from a lateral edge of a front side of the lower-body piece.

5. The clothing set forth in claim 1, wherein the lower-body second support section extends from the vertex of the V-shape upward and laterally.

6. The clothing set forth in claim 1, wherein the lower body first support section is configured to follow at least a portion of a psoas major muscle of the body, wherein the lower-body second support section is configured to follow an iliacus muscle of the body, and wherein the lower-body support unit further includes a lower-body third support section configured to follow a piriformis muscle of the body.

7. The clothing set forth in claim 1, wherein each of the lower-body first support section and the lower-body second support section terminates at the vertex of the V-shape.

8. The clothing set forth in claim 1, wherein the lower-body support unit is contained within the pelvic area of the lower-body piece.

9. Clothing for covering a body of a wearer, the clothing comprising:

an upper-body piece for covering at least a portion of an upper half of the body;

a lower-body piece for covering at least a portion of a lower half of the body;

an upper-body support unit on the upper-body piece; and a lower-body support unit on the lower-body piece, wherein the upper-body support unit includes an upper-body first support section configured to follow at least a portion of a psoas major muscle of the body, an upper-body second support section configured to follow a supraspinatus muscle of the body, and an upper-body third support section configured to follow a teres major muscle of the body; and wherein the lower-body support unit includes a lower-body first support section and a lower-body second support section forming a V-shape, the lower-body first support section extending from a medial top region of the lower-body piece downwardly and laterally to a vertex of the V-shape, and wherein the lower body piece does not include a support unit below the vertex of the V-shape on a front side of the lower-body piece.

10. Clothing for covering a body of a wearer, the clothing comprising:

upper and lower clothing core pieces for covering at least a portion of an upper half of the body and at least a portion of a lower half of the body; and support units formed on the upper and lower clothing core pieces;

wherein the support units include:

a lower-body first support section and a lower-body second support section forming a V-shape, the lower-body first support section extending from a medial top region of the lower clothing core piece downwardly and laterally to a vertex of the V-shape, wherein the lower clothing core piece does not include a support unit below the vertex of the V-shape on a front side of the lower clothing core piece, upper-body first support sections configured to follow supraspinatus muscles of the body, upper-body second support sections configured to follow *teres* major muscles of the body, and lower-body third support sections configured to follow piriformis muscles of the body.

* * * * *